US011433676B2

(12) United States Patent
Kobayashi et al.

(10) Patent No.: US 11,433,676 B2
(45) Date of Patent: Sep. 6, 2022

(54) LIQUID EJECTING APPARATUS

(71) Applicant: SEIKO EPSON CORPORATION, Tokyo (JP)

(72) Inventors: Haruki Kobayashi, Matsumoto (JP); Eiichiro Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 28 days.

(21) Appl. No.: 17/036,150

(22) Filed: Sep. 29, 2020

(65) Prior Publication Data

US 2021/0094299 A1 Apr. 1, 2021

(30) Foreign Application Priority Data

Sep. 30, 2019 (JP) ..... JP2019-178879

(51) Int. Cl.
*B41J 2/165* (2006.01)
*B41J 2/14* (2006.01)

(52) U.S. Cl.
CPC ..... *B41J 2/16535* (2013.01); *B41J 2/1433* (2013.01)

(58) Field of Classification Search
CPC .. B41J 2/1433; B41J 2/14314; B41J 2/14201; B41J 2/14129; B41J 2/14145; B41J 2/14
See application file for complete search history.

(56) References Cited

U.S. PATENT DOCUMENTS 5,953,025 A * 9/1999 Sakurai ..... B41J 2/16544 347/33
2005/0046668 A1* 3/2005 Owaki ..... B41J 2/14145 347/44
2005/0231548 A1 10/2005 Tsukada
2011/0304678 A1 12/2011 Yamamoto
2015/0328895 A1 11/2015 Kudo
2017/0253036 A1 9/2017 Miyajima

FOREIGN PATENT DOCUMENTS

JP 2002-052728 2/2002
JP 2002-067288 3/2002
JP 2002-160377 6/2002
JP 2002-294783 10/2002
JP 2004-025488 1/2004
JP 2004-098477 4/2004
JP 2009-073082 4/2009
(Continued)

*Primary Examiner* — Jason S Uhlenhake
(74) *Attorney, Agent, or Firm* — Workman Nydegger

(57) ABSTRACT

A liquid ejecting apparatus includes: a liquid ejecting head having a nozzle plate, a case head disposed in a second-direction opposite to a first-direction with respect to the nozzle plate, and a lid member; and a carriage having an outer wall surrounding a periphery of the nozzle plate, in which the lid member has a first-surface, a second-surface, and a third-surface, the first-surface is disposed in the first direction with respect to the nozzle plate, the second-surface is coupled to the first-surface and is disposed to cover a part of a side surface of the case head in a third-direction orthogonal to the first-direction, the third-surface is coupled to the second-surface to extend in the third-direction, and is disposed so as not to abut on the outer wall, and an end portion of the third-surface in the third-direction overlaps the outer wall when viewed in the second-direction.

16 Claims, 20 Drawing Sheets

(56) References Cited

FOREIGN PATENT DOCUMENTS

| | | |
|---|---|---|
| JP | 2012-000799 | 1/2012 |
| JP | 2015-217570 | 12/2015 |
| JP | 2017-154416 | 9/2017 |
| JP | 2018-012256 | 1/2018 |
| JP | 2018-135081 | 8/2018 |
| JP | 2019-025703 | 2/2019 |
| JP | 2019-116775 | 7/2019 |

* cited by examiner

LIQUID EJECTING APPARATUS

The present application is based on, and claims priority from JP Application Serial Number 2019-178879, filed Sep. 30, 2019, the disclosure of which is hereby incorporated by reference herein its entirety.

BACKGROUND

1. Technical Field

The present disclosure relates to a liquid ejecting apparatus.

2. Related Art

A liquid ejecting apparatus such as a printer includes a liquid ejecting head mounted on a carriage. For example, JP-A-2002-52728 discloses a liquid ejecting apparatus in which a gap is provided between a liquid ejecting head and a carriage, and a wiping member wipes a nozzle forming surface of the liquid ejecting head.

In a technology disclosed in JP-A-2002-52728, there is a risk that ink enters the inside of the carriage via a gap between the liquid ejecting head and the carriage.

SUMMARY

According to an embodiment of the present disclosure, a liquid ejecting apparatus is provided. This liquid ejecting apparatus includes: a liquid ejecting head that has a nozzle plate provided with a plurality of nozzles for ejecting a liquid in a first direction, a case head disposed in a second direction opposite to the first direction with respect to the nozzle plate and configured to supply a liquid to the nozzle, and a lid member provided with an opening exposing the plurality of nozzles and configured to cover the first direction side of the nozzle plate and a third direction side of the nozzle plate and the case head, the third direction orthogonal to the first direction; and a carriage on which the liquid ejecting head is mounted and which has an outer wall surrounding a periphery of the nozzle plate when viewed in the second direction, in which the lid member has a first surface, a second surface, and a third surface, the first surface is disposed in the first direction with respect to the nozzle plate, the second surface is coupled to the first surface and is disposed to cover a part of a side surface of the case head in the third direction, the third surface is coupled to the second surface to extend in the third direction and is disposed so as not to abut on the outer wall, and an end portion of the third surface in the third direction overlaps the outer wall when viewed in the second direction.

DESCRIPTION OF EXEMPLARY EMBODIMENTS

A. First Embodiment

Figure 1:
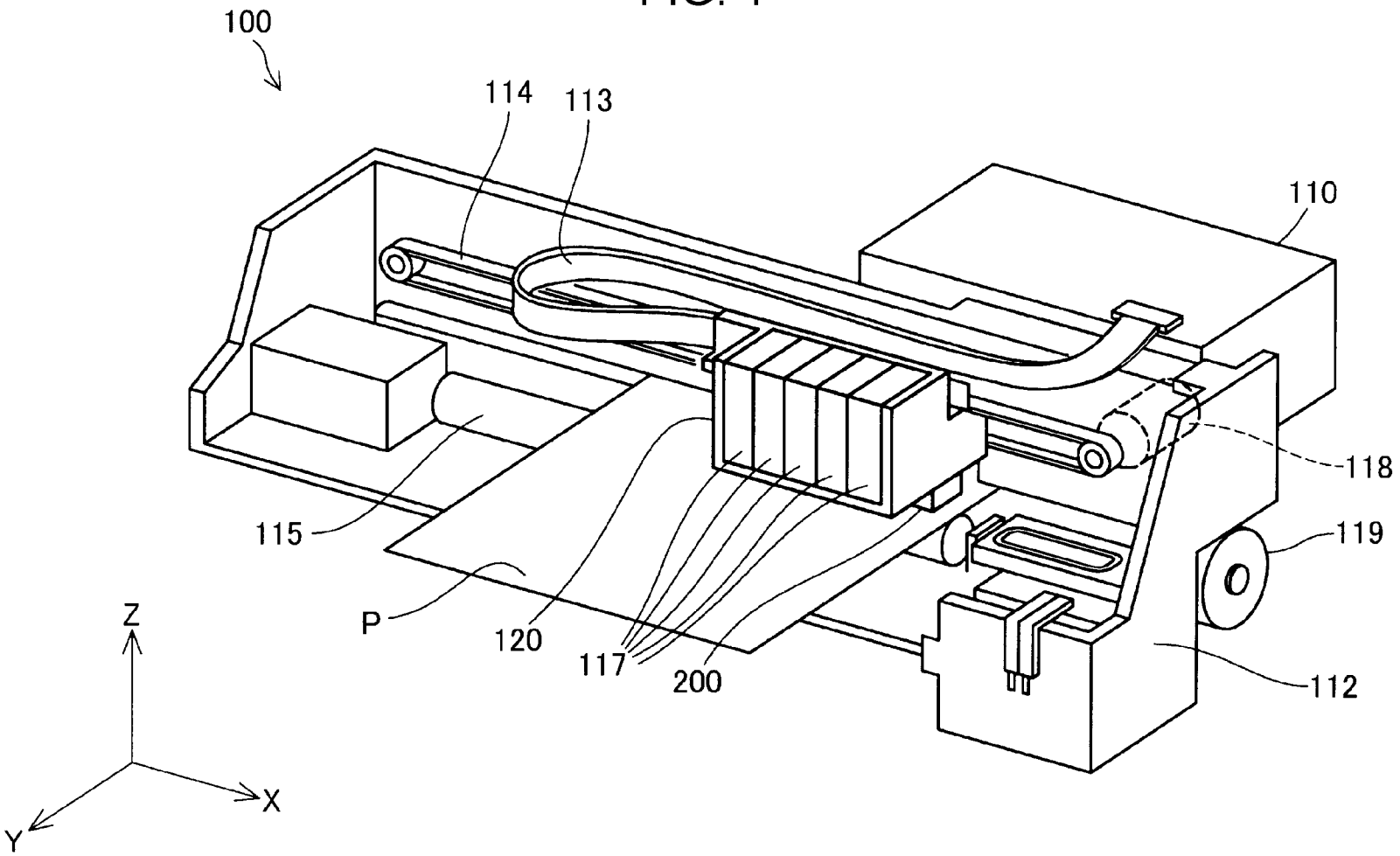
FIG. 1 is an explanatory view illustrating a schematic configuration of a liquid ejecting apparatus according to an embodiment of the present disclosure.

A1. Configuration of Liquid Ejecting Apparatus:

FIG. 1 is an explanatory view illustrating a schematic configuration of a liquid ejecting apparatus 100 according to an embodiment of the present disclosure. The liquid ejecting apparatus 100 is configured as an ink jet printer that ejects ink. The liquid ejecting apparatus 100 converts image data received from a liquid ejecting control device that is not illustrated into printing data indicating an ON state/an OFF state of dots on a printing medium P, and forms the dots on the printing medium P by ejecting ink onto the printing medium P based on the printing data, thereby printing an image.

The liquid ejecting apparatus 100 includes a liquid ejecting head 200, a carriage 120, five ink cartridges 117, a carriage motor 118, a transport motor 119, a drive belt 114, a flexible flat cable 113, a platen 115, a control section 110, and a housing 112.

The liquid ejecting head 200 is mounted on the carriage 120 and is electrically coupled to the control section 110 via the flexible flat cable 113. The carriage 120 is attached to a carriage guide that is not illustrated to be able to reciprocate in a main scanning direction X. The carriage 120 is coupled to the carriage motor 118 via the drive belt 114, and reciprocates along the main scanning direction X as the carriage motor 118 rotates. The housing 112 accommodates the liquid ejecting head 200, the carriage 120, the five ink cartridges 117, the carriage motor 118, the transport motor 119, the drive belt 114, the flexible flat cable 113, and the platen 115. In FIG. 1, in order to make an internal configuration of the housing 112 easy to see, illustration of a part of the housing 112 is omitted. The housing 112 may be configured to accommodate the control section 110.

Five ink cartridges 117 for ink colors are mounted on the carriage 120. The five ink cartridges 117 accommodate, for example, cyan ink, magenta ink, yellow ink, matte black ink, and photo black ink, respectively. The liquid ejecting head 200 is provided with a nozzle row 281 including a plurality of nozzles 282 for discharging ink on a surface facing the printing medium P. The ink supplied from the ink cartridge 117 to the liquid ejecting head 200 is ejected from the nozzle 282 onto the printing medium P in the form of liquid droplets.

The transport motor 119 operates according to a control signal from the control section 110. By transmitting power of the transport motor 119 to the platen 115, the printing medium P is transported along a sub-scanning direction Y.

The control section 110 includes one or a plurality of CPUs (Central Processing Units), processing circuits such as FPGAs (Field Programmable Gate Arrays), and storage circuits such as semiconductor memories, and integrally controls the transport motor 119 and the carriage 120. In detail, when generation of the printing data is completed, the control section 110 drives the transport motor 119 to transport the printing medium P to a printing start position in the sub-scanning direction Y. The control section 110 drives the carriage motor 118 to move the carriage 120 to the printing start position in the main scanning direction X. The control section 110 alternately repeats control in which the carriage 120 moves along the main scanning direction X and the ink is ejected from the liquid ejecting head 200 to the printing medium P and control of the transport motor 119 for transporting the printing medium P in the sub-scanning direction Y, which is a printing direction. Accordingly, an image is printed on the printing medium P.

In FIG. 1, the carriage 120 reciprocates along the main scanning direction X, and the printing medium P is transported from an upstream side to a downstream side in the sub-scanning direction Y intersecting the main scanning direction X. In the present embodiment, the sub-scanning direction Y is a direction orthogonal to the main scanning direction X. A Z axis is parallel to the vertical direction. An X axis and a Y axis are parallel to the horizontal direction and are orthogonal to the Z axis. In these directions, a direction indicated by an arrow is indicated by "+", and a direction opposite to the direction indicated by the arrow is indicated by "−". The arrows indicating the directions are illustrated also in the drawings to be referred to later to correspond to FIG. 1. In the following description, a −Z direction is referred to as a first direction D1, a +Z direction is referred to as a second direction D2, a −X direction is referred to as a third direction D3, and a +X direction is referred to as a fourth direction D4. The −Z direction corresponds to a vertically downward direction, and the +Z direction corresponds to a vertically upward direction.

Figure 2:
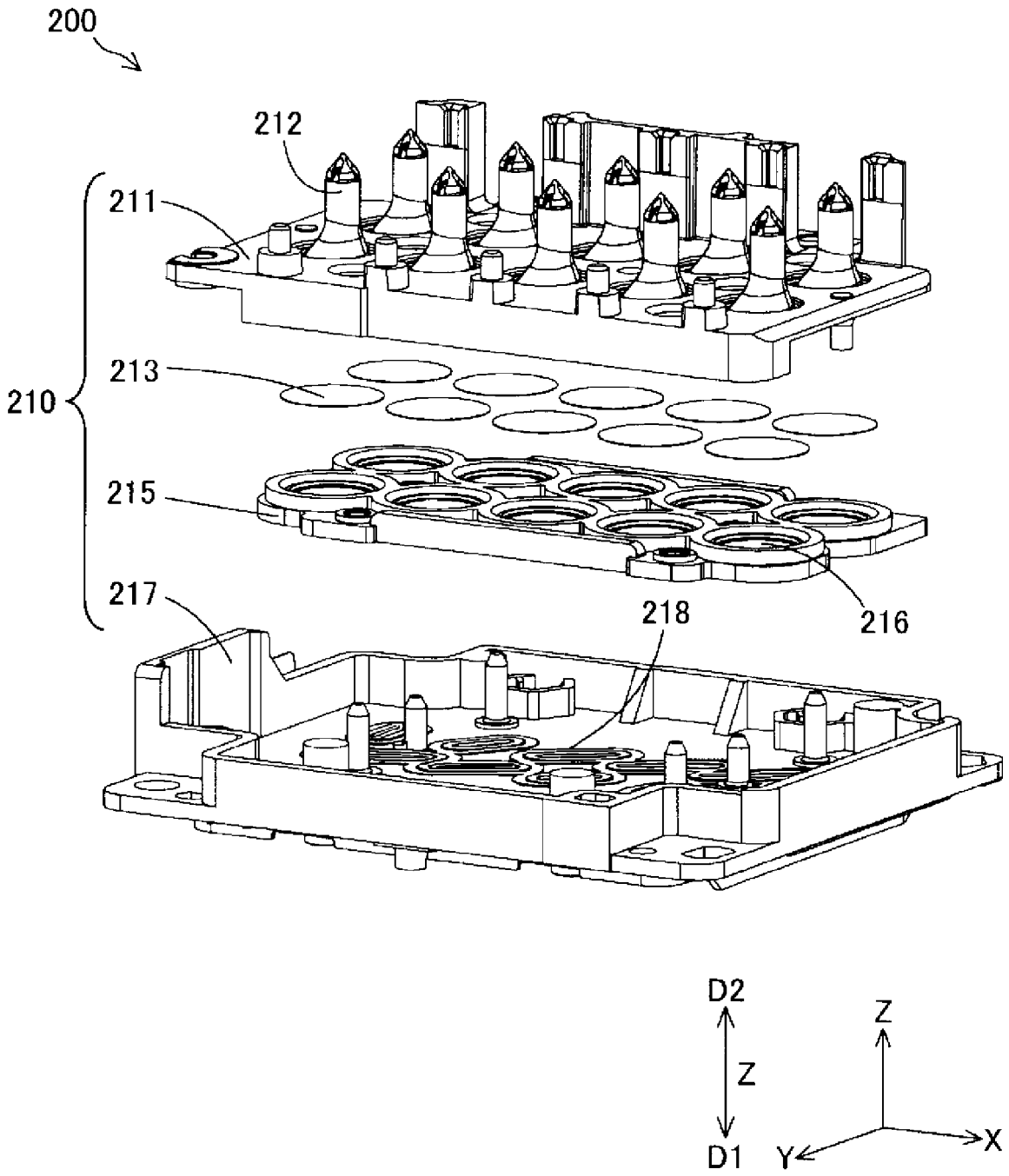
FIG. 2 is an exploded perspective view illustrating a schematic configuration of a liquid ejecting head.
Figure 3:
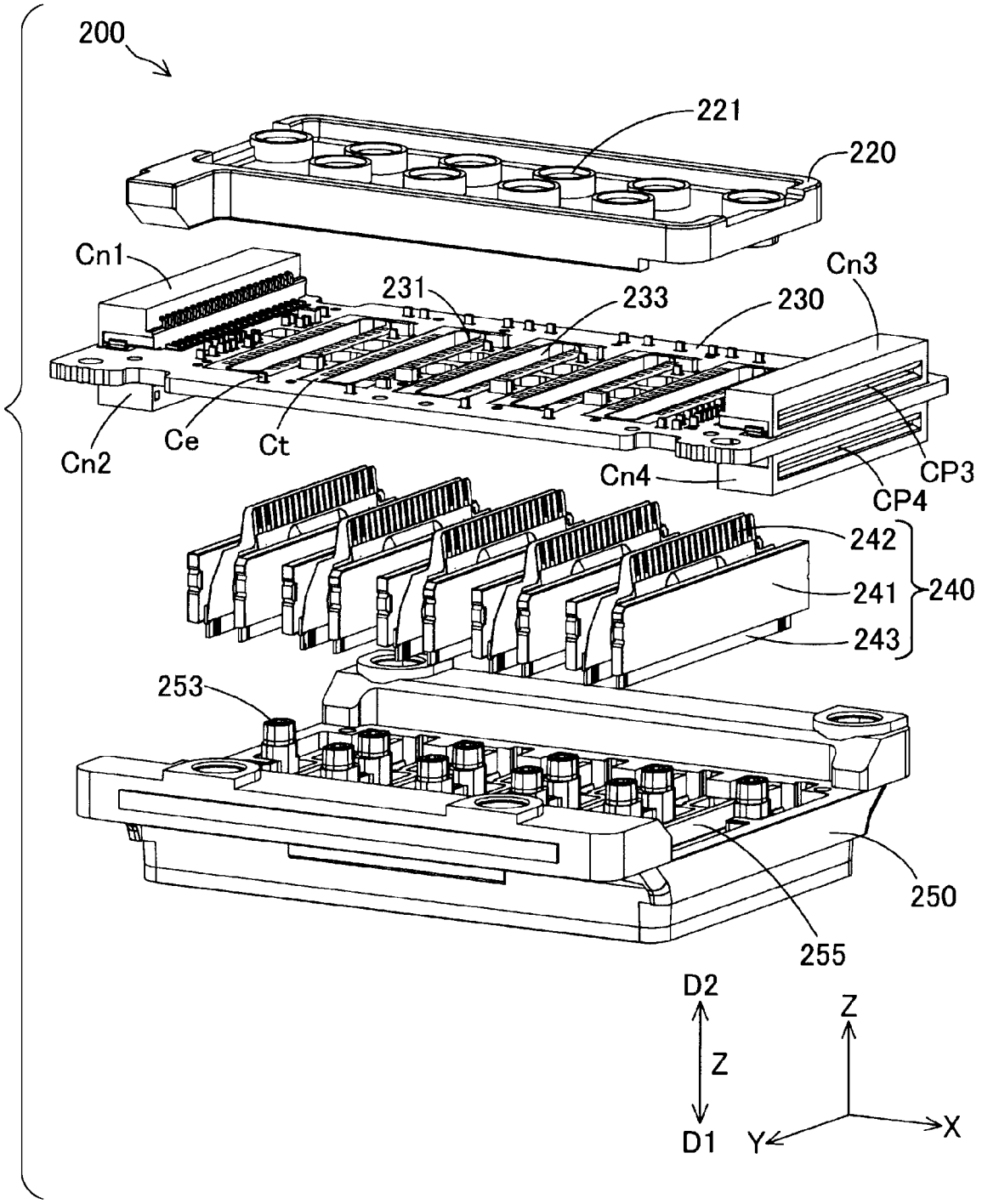
FIG. 3 is an exploded perspective view illustrating the schematic configuration of the liquid ejecting head.
Figure 4:
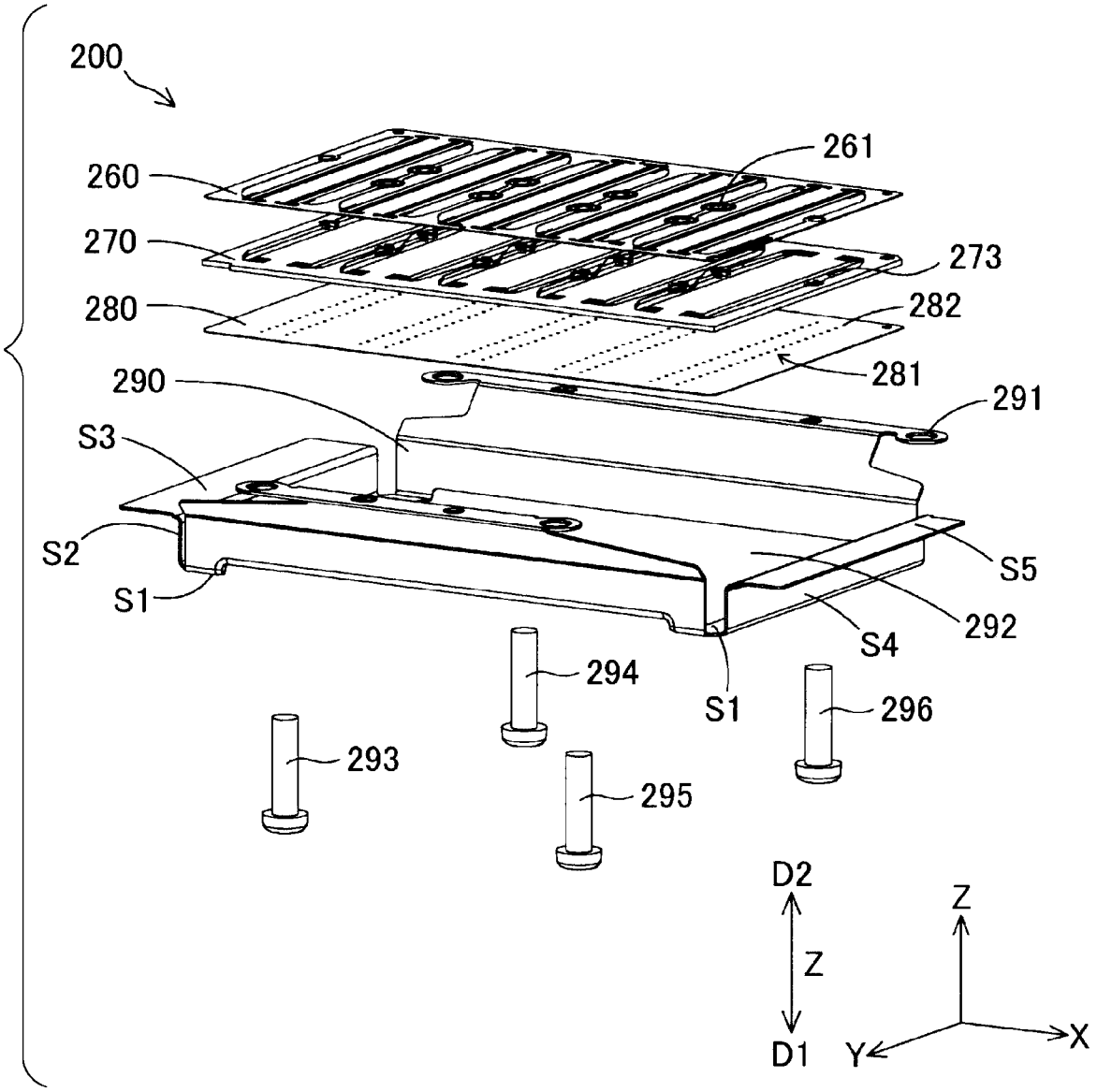
FIG. 4 is an exploded perspective view illustrating the schematic configuration of the liquid ejecting head.

A2. Configuration of Liquid Ejecting Head:

FIGS. 2, 3 and 4 are exploded perspective views illustrating a schematic configuration of the liquid ejecting head 200.

As illustrated in FIGS. 2, 3 and 4, the liquid ejecting head 200 includes a holder 210, a seal member 220, a circuit board 230, and an actuator section 240, a case head 250, a vibration plate 260, a flow path forming member 270, a nozzle plate 280, and a lid member 290 in an order from the second direction D2 toward the first direction D1. The liquid ejecting head 200 is configured by stacking these components and fastening the components using four screws 293, 294, 295, and 296.

As illustrated in FIG. 2, the holder 210 holds the ink cartridge 117 in cooperation with the carriage 120, and causes the ink supplied from the ink cartridge 117 to flow into the case head 250 through a flow path formed therein. The holder 210 includes a first flow path plate 211, a filter 213, an attachment plate 215, and a second flow path plate 217.

The first flow path plate 211 includes an ink supply needle 212, and causes the ink supplied from the ink cartridge 117 to pass through the inside of the ink supply needle 212 and to flow into a first flow path 216 that is not illustrated and is included in the attachment plate 215. The ink supply needle 212 includes a disk-shaped member and a needle member protruding in the second direction D2. A through-hole that penetrates the ink supply needle 212 in the Z direction is provided inside the ink supply needle 212, and the through-hole functions as a flow path for ink. The ink cartridge 117 is fixed to the first flow path plate 211 by inserting a claw portion that is not illustrated and is provided in the ink cartridge 117 into the ink supply needle 212.

The filter 213 removes bubbles and foreign substances contained in the ink supplied from the ink cartridge 117. The filter 213 has a disk shape, and is fixed to an opening surface of the first flow path 216 of the attachment plate 215 on the second direction D2 side by adhesion via heat welding, adhesive, or the like. A sheet-shaped component having a plurality of fine holes formed by finely knitting fibers such as metal and resin or a plate-shaped component made of metal, resin, or the like and penetrated by a plurality of fine holes can be used as the filter 213.

The attachment plate 215 is a long plate-shaped member of which the longitudinal direction is the X direction, and has a through-hole constituting the first flow path 216. The first flow path 216 supplies the ink, from which the foreign substances are removed by the filter 213, to a second flow path 218 formed in the second flow path plate 217.

The second flow path plate 217 is a long box-shaped member which is open on the second direction D2 side and of which the longitudinal direction is the X direction. The second flow path plate 217 is provided with a groove constituting the second flow path 218. The second flow path 218 is formed by a groove extending in the X direction from a surface of the second flow path plate 217 on the second direction D2 side. The second flow path 218 supplies the ink supplied from the first flow path 216 to an ink introduction port 221 of the seal member 220 illustrated in FIG. 3.

As described above, the first flow path 216 causes the ink supplied from the ink cartridge 117 via the ink supply needle 212 to flow into the second flow path 218, and the second flow path 218 causes the ink flowing from the first flow path 216 to flow into a case head 250 via the ink introduction port 221 of the seal member 220.

As illustrated in FIG. 3, the seal member 220 is a substantially rectangular plate-shaped member of which the longitudinal direction is the X direction. The seal member 220 is made of, for example, an elastic member such as rubber or elastomer. The ink introduction port 221 is formed in the seal member 220.

The ink introduction port 221 is a through-hole that penetrates the seal member 220. The ink introduction port 221 causes the second flow path 218 of the second flow path plate 217 illustrated in FIG. 2 and a third flow path 253 of the case head 250 illustrated in FIG. 3 to communicate with each other such that the ink supplied from the ink cartridge 117 flows into the case head 250. When the components of the liquid ejecting head 200 are stacked and fastened, the seal member 220 is sandwiched between the holder 210 illustrated in FIG. 2 and the case head 250 illustrated in FIG. 3 in a state in which a predetermined pressing force is applied therebetween, so that the second flow path 218 of the holder 210 and the third flow path 253 of the case head 250 are liquid-tightly sealed. In detail, the seal member 220 causes an opening of the through-hole, which is provided on a surface of the second flow path plate 217 on the first direction D1 side and forms the second flow path 218, and the ink introduction port 221 to liquid-tightly communicate with each other. Further, the seal member 220 causes the ink introduction port 221 and the third flow path 253 to liquid-tightly communicate with each other.

The circuit board 230 is a substantially rectangular plate-shaped member of which the longitudinal direction is the X direction. As illustrated in FIGS. 2 and 3, the circuit board 230 is disposed between the holder 210 and the case head 250, and is disposed adjacent to the seal member 220 on the first direction D1 side as illustrated in FIG. 3. For example, the circuit board 230 is fixed to a surface of the case head 250 on the second direction D2 side with an adhesive. The circuit board 230 is an electronic board on which wiring for driving a piezoelectric body 243, which will be described below and is included in the actuator section 240, a circuit element Ce, and the like are integrated. The circuit board 230 includes the circuit element Ce, a through-hole 231, an opening 233, a connection terminal Ct, and connectors Cn1, Cn2, Cn3 and Cn4.

The circuit element Ce is a discrete component such as a resistor, a capacitor, a transistor, and a coil. The circuit element Ce is three-dimensionally stacked on a surface of the circuit board 230 on the second direction D2 side. In other words, the circuit element Ce is stacked on the circuit board 230 to slightly protrude from the surface of the circuit board 230 on the second direction D2 side in the second direction D2.

The through-hole 231 is a through-hole that penetrates the circuit board 230. The through-hole 231 is provided at a position that overlaps the ink introduction port 221 of the seal member 220 when viewed in the first direction D1, and is provided at a position that overlaps the third flow path 253, which will be described below, of the case head 250 when viewed in the second direction D2. It should be noted that the above-mentioned "when viewed in the first direction D1" means when the circuit board 230 is viewed in a plan view in the first direction D1.

The opening 233 is a through-hole that penetrates the circuit board 230 and is provided in parallel with the Y direction. A plurality of the openings 233 are provided side by side in the X direction. A COF substrate 242 of the actuator section 240 is inserted into the opening 233. A tip portion of the COF substrate 242 on the second direction D2 side, which protrudes from the opening 233 in the second direction D2, is bent in the −X direction or the +X direction and is coupled to the connection terminal Ct.

The connectors Cn1, Cn2, Cn3, and Cn4 are provided at end portions of the circuit board 230 in the X direction. In detail, the connector Cn1 is provided on a surface of the circuit board 230 on the second direction D2 side in the −X direction. The connector Cn2 is provided on a surface of the circuit board 230 on the first direction D1 side in the −X direction. The connector Cn3 is provided on a surface of the circuit board 230 on the second direction D2 side in the +X direction. The connector Cn4 is provided on a surface of the circuit board 230 on the first direction D1 side in the +X direction. The flexible flat cable 113, which is an example of a "signal cable", is attached to each of the connectors Cn1, Cn2, Cn3, and Cn4. The connectors Cn1 and Cn2 are provided with insertion ports CP1 and CP2 opening in the third direction D3, and the connectors Cn3 and Cn4 are provided with insertion ports CP3 and CP4 opening in the fourth direction D4. The corresponding flexible flat cables 113 are inserted into the insertion ports CP1, CP2, CP3, and CP4, respectively, and the connectors Cn1, Cn2, Cn3, and Cn4 and the flexible flat cables 113 are electrically coupled to each other. Cables coupled to the connectors Cn1, Cn2, Cn3, and Cn4 are not limited to the flexible flat cable 113, and predetermined other types of signal cables may be mounted on the connectors Cn1, Cn2, Cn3, and Cn4.

The actuator section 240 includes the COF substrate 242, a fixing plate 241, and the piezoelectric body 243. A driving circuit for driving the piezoelectric body 243 is provided on the COF substrate 242. An end portion of the COF substrate 242 on the first direction D1 side is coupled to the piezoelectric body 243.

An end portion of the COF substrate 242 on the second direction D2 side is inserted into the opening 233 of the circuit board 230 and is coupled to the connection terminal Ct. The piezoelectric body 243 constitutes a piezoelectric element which is a passive element using a piezoelectric effect, and is driven according to a drive signal from the control section 110. The fixing plate 241 is fixed to a wall surface of an accommodation space 255 of the case head 250. The piezoelectric body 243 is fixed to the vibration plate 260 such that an end portion on the first direction D1 side serves as a free end, and is fixed to an end portion of the fixing plate 241 on the first direction D1 side such that an end portion on the second direction D2 side serves as a fixed end.

The case head 250 is provided between the circuit board 230 and the vibration plate 260 illustrated in FIG. 4. The case head 250 is made of, for example, a synthetic resin such as polypropylene. The case head 250 includes the accommodation space 255 and the third flow path 253. The accommodation space 255 is provided along the Y direction, and is formed by a recess portion that is open in the second direction D2.

The accommodation space 255 accommodates the COF substrate 242, the fixing plate 241, and the piezoelectric body 243.

A part of the third flow path 253 is formed inside a cylindrical member protruding in the second direction D2. The third flow path 253 causes the ink introduction port 221 of the seal member 220 and an ink introduction port 261 of the vibration plate 260, which will be described later, to communicate with each other.

As illustrated in FIG. 4, the vibration plate 260 is a substantially rectangular plate-shaped member of which the longitudinal direction is the X direction. The vibration plate 260 is provided between the case head 250 and the flow path forming member 270. The vibration plate 260 functions as a wall surface that closes a surface of the flow path forming member 270 on the second direction D2 side. The vibration plate 260 is elastically deformed by the piezoelectric body 243. Accordingly, the ink is discharged from a pressure chamber that is not illustrated via the nozzle 282. The vibration plate 260 is formed, for example, by laminating an elastic film made of an elastic member such as a resin film and a support plate for supporting the elastic film and made of a metal material such as stainless steel (SUS). The elastic film is supported by being joined to a surface of the support plate on the first direction D1 side.

The vibration plate 260 includes the ink introduction port 261. The ink introduction port 261 is a through-hole that penetrates the vibration plate 260. The ink introduction port 261 communicates with the third flow path 253 and a fourth flow path 273 formed in the flow path forming member 270, which will be described below, and causes the ink supplied from the ink cartridge 117 to flow into the fourth flow path 273.

The flow path forming member 270 is a plate-shaped member having an outer shape that coincides with the outer shape of the vibration plate 260. The flow path forming member 270 is provided between the case head 250 and the nozzle plate 280. The flow path forming member 270 includes the fourth flow path 273 and the pressure chamber that is not illustrated.

The fourth flow path 273 communicates with the third flow path 253 formed in the case head 250. The pressure chamber is configured by sealing a recess portion, which is not illustrated and is formed in the flow path forming member 270, by the vibration plate 260 from the second direction D2 side. That is, a surface of the pressure chamber on the second direction D2 side is formed by the vibration plate 260, and the volume in the pressure chamber is changed by displacing the vibration plate 260 according to displacement of the piezoelectric body 243.

Although illustration is omitted, the pressure chamber is provided side by side in the Y direction to correspond to the nozzle row 281. The pressure chamber communicates with the fourth flow path 273 and the nozzle 282, and the ink that has flowed into the pressure chamber from the fourth flow path 273 is ejected from the nozzle 282 by changing the volume of the pressure chamber. Therefore, the first flow path 216, the second flow path 218, the third flow path 253, and the fourth flow path 273 are coupled to one nozzle 282 via the pressure chamber. In the present embodiment, the flow path forming member 270 is formed of, for example, silicon (Si). The flow path forming member 270 may have a configuration in which a plurality of substrates are stacked.

The nozzle plate 280 is a thin plate-shaped member having an outer shape that coincides with the outer shapes of the vibration plate 260 and the flow path forming member 270. The nozzle plate 280 is provided in the flow path forming member 270 on the first direction D1 side. The nozzle plate 280 includes 10 nozzle rows 281 each including the plurality of nozzles 282 lined up along the Y direction. The nozzle 282 is a through-hole that penetrates the nozzle plate 280, and is a through-hole for ejecting the ink onto the printing medium P. The plurality of nozzle rows 281 are arranged side by side in the X direction. Each nozzle row 281 is provided at a position corresponding to the pressure chamber in the flow path forming member 270. The nozzle plate 280 functions as a wall surface that closes a surface of the flow path forming member 270 in the first direction D1 in a portion where the nozzle 282 is not provided. The nozzle plate 280 is formed of, for example, stainless steel (SUS), silicon (Si), or the like. The number of the nozzle rows 281 may be a predetermined other number instead of ten.

The case head 250, the vibration plate 260, the flow path forming member 270, and the nozzle plate 280, which have been described above, are fixed to each other with an adhesive. In detail, a surface of the nozzle plate 280 on the second direction D2 side and the surface of the flow path forming member 270 on the first direction D1 side are bonded to each other with an adhesive. Further, the surface of the flow path forming member 270 on the second direction D2 side and a surface of the vibration plate 260 on the first direction D1 side are bonded to each other with an adhesive. A surface of the vibration plate 260 on the second direction D2 side and a surface of the case head 250 on the first direction D1 side are bonded to each other with an adhesive. The adhesive may be applied to the respective components 250, 260, 270 and 280.

The lid member 290 is a frame that accommodates parts of the vibration plate 260, the flow path forming member 270, the nozzle plate 280, and the case head 250. The lid member 290 is a box-shaped member having an opening 292 in the first direction D1. The lid member 290 includes a first surface S1 that defines a bottom surface, a second surface S2 and a fourth surface S4 that define side surfaces, a flange-shaped third surface S3 that is bent at a substantially right angle from the second surface S2 and extends outward, and a flange-shaped fifth surface S5 that is bent at a substantially right angle from the fourth surface S4 and extends outward. The second surface S2 and the fourth surface S4, and the third surface S3 and the fifth surface S5 have substantially the same configuration. The lid member 290 is formed by one member, and the surfaces of the lid member 290 are coupled to each other. In detail, the first surface S1, the second surface S2, and the third surface S3 are coupled to each other, and the first surface S1, the fourth surface S4, and the fifth surface S5 are coupled to each other. The opening 292 formed in the first surface S1 exposes a surface of the nozzle plate 280 on the first direction D1 side when the vibration plate 260, the flow path forming member 270, the nozzle plate 280, and the case head 250 are accommodated in the lid member 290. Detailed description of the lid member 290 will be provided below.

The lid member 290 is provided with four fixing portions 291 into which screws 293, 294, 295 and 296 are inserted. The lid member 290 is fixed to the holder 210 using the screws 293, 294, 295, and 296 with the case head 250 and the circuit board 230 interposed therebetween.

The constituent members of the liquid ejecting head 200 described above are stacked and fastened by the four screws 293, 294, 295, and 296. The four screws 293, 294, 295, and 296 are configured by, for example, all screws. The screws 293, 294, 295 and 296 are inserted into screw holes that are not illustrated and are formed in the case head 250 in advance and are tightened, so that the holder 210, the case head 250, and the lid member 290 are fastened to each other.

Figure 5:
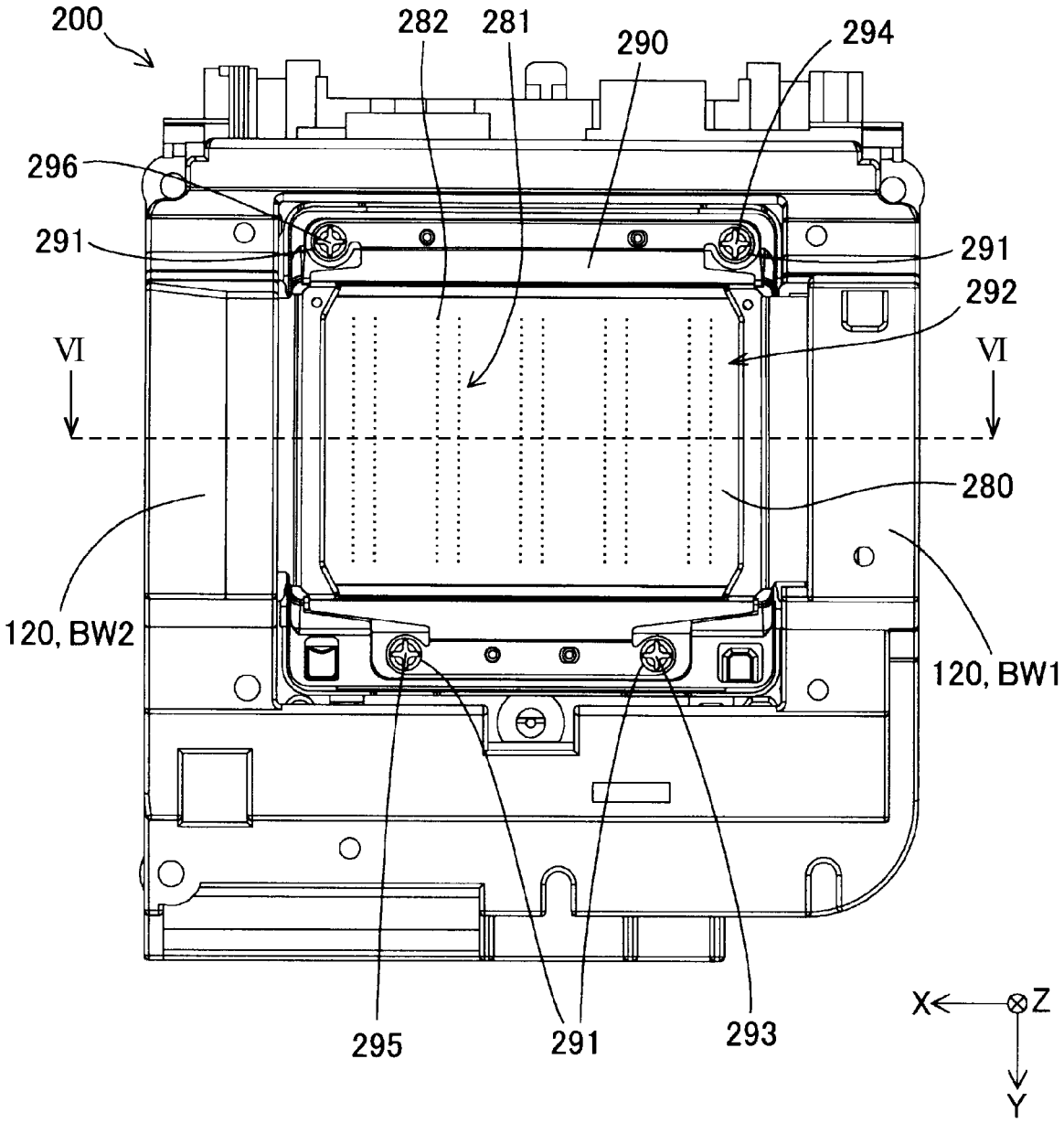
FIG. 5 is a bottom view of the liquid ejecting head.
Figure 6:
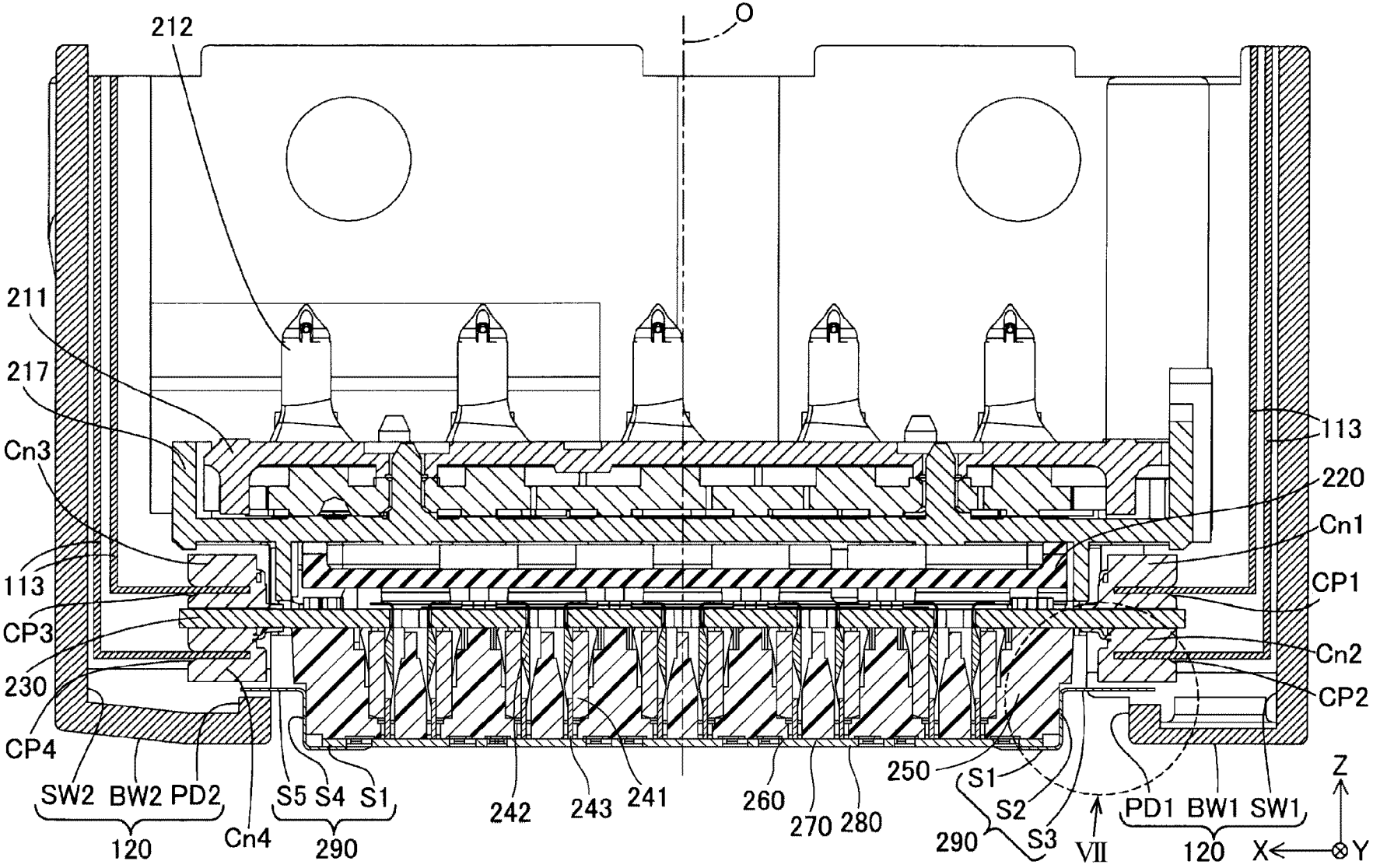
FIG. 6 is a cross-sectional view of the liquid ejecting head and a carriage taken along line VI-VI in FIG. 5.
Figure 7:
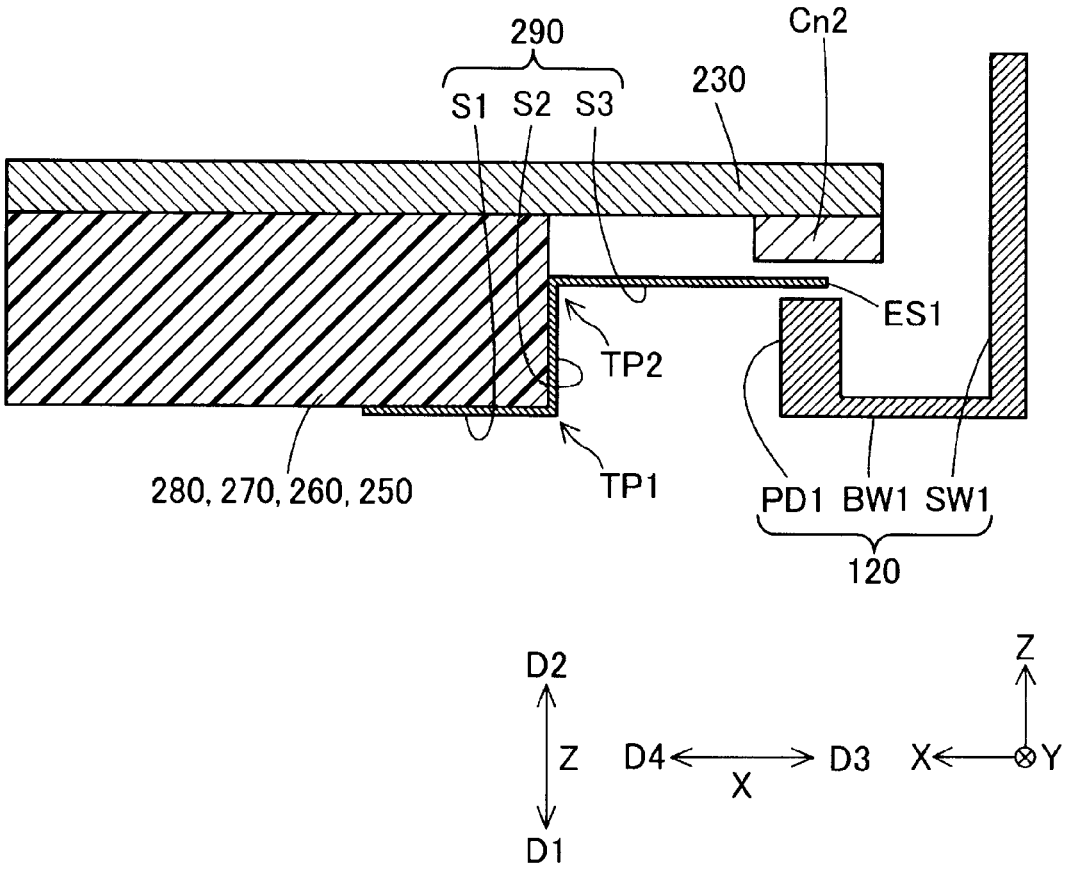
FIG. 7 is an enlarged view of a region illustrated in FIG. 6.
Figure 8:
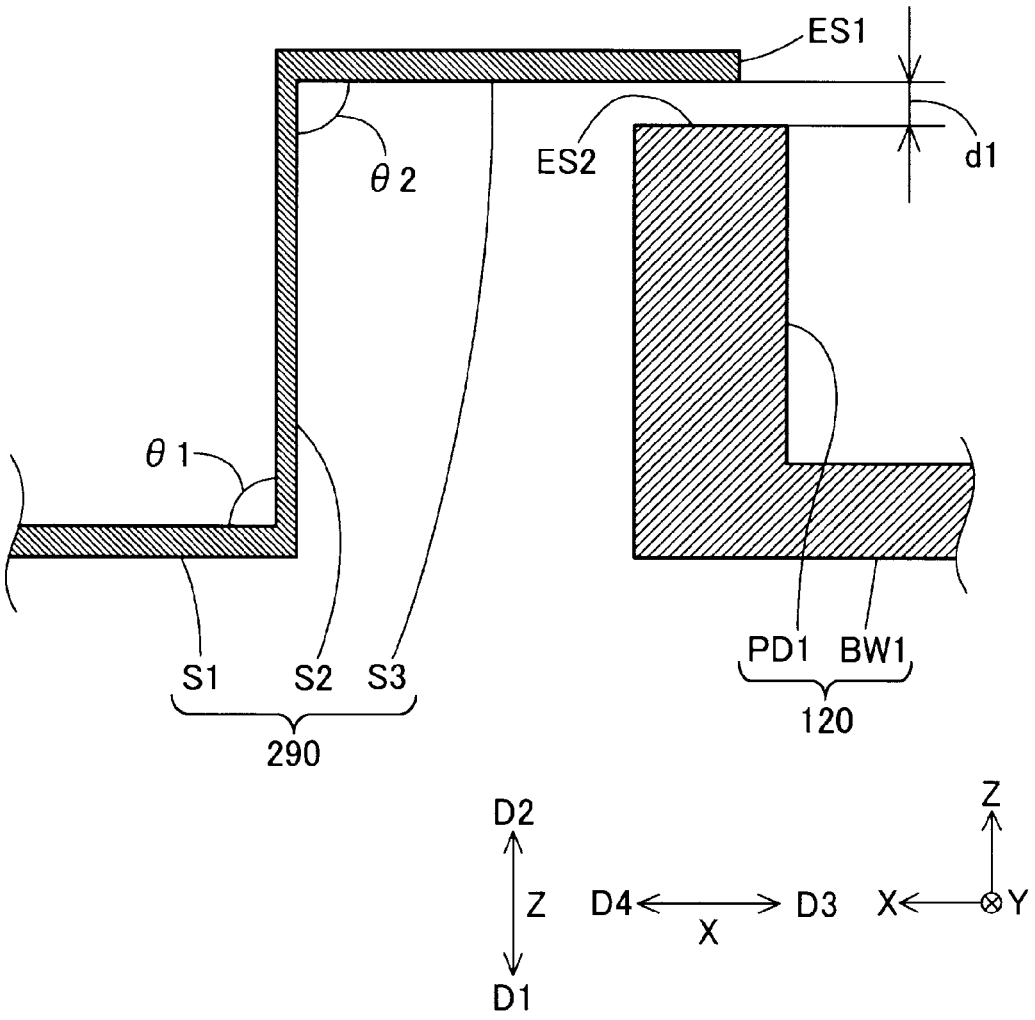
FIG. 8 is an enlarged view of a lid member and the carriage illustrated in FIG. 7.

A3. Arrangement Configuration of Lid Member and Carriage:

FIG. 5 is a bottom view of the liquid ejecting head 200. FIG. 5 is a plan view if the liquid ejecting head 200 is viewed from the first direction D1 in a plan view, when the liquid ejecting head 200 is mounted on the carriage 120 in a state in which the respective members constituting the liquid ejecting head 200 are stacked and fastened. FIG. 6 is a cross-sectional view of the liquid ejecting head and the carriage taken along the line VI-VI in FIG. 5. FIG. 7 is an enlarged view of a region VII illustrated in FIG. 6. FIG. 8 is an enlarged view of the lid member 290 and the carriage 120 illustrated in FIG. 7. In FIGS. 6 and 7, illustration of the screw 293 and the screw 295 is omitted, and in FIG. 7, the nozzle plate 280, the flow path forming member 270, the vibration plate 260, and the case head 250 are collectively illustrated as one member. An arrangement configuration of the lid member 290 and the carriage 120 is the same in the +X direction, the −X direction, the +Y direction, and the −Y direction. In FIGS. 7 and 8, the arrangement configuration on the −X direction side will be described as a representative.

As illustrated in FIG. 5, the liquid ejecting head 200 is fastened and attached to the carriage 120 such that the surface of the nozzle plate 280 on the first direction D1 side is exposed from the opening 292 of the lid member 290. That is, the nozzle 282 is exposed to the opening 292 of the lid member 290.

A bottom wall portion of the carriage 120 is arranged to surround the periphery of the nozzle plate 280 when viewed in the second direction D2. A bottom wall portion BW1 is a portion of the bottom wall portion of the carriage 120 disposed on the −X direction side of the nozzle plate 280, and a bottom wall portion BW2 is a portion of the carriage 120 disposed on the +X direction side of the nozzle plate 280.

As illustrated in FIG. 6, on the −X direction side and the +X direction side of the lid member 290, the first surface S1 of the lid member 290 is disposed to cover a part of the surface of the nozzle plate 280 on the first direction D1 side. On the −X direction side of the lid member 290, the second surface S2 of the lid member 290 is disposed to cover the surfaces of the nozzle plate 280, the flow path forming member 270, and the vibration plate 260 on the −X direction side and a part of a surface of the first case head 250 on the −X direction side. On the −X direction side of the lid member 290, the third surface S3 of the lid member 290 extends in the −X direction along the X axis, and is disposed on the first direction D1 side from the connector Cn2 provided on the first direction D1 side of the circuit board 230. An end portion of the third surface S3 on the −X direction side overlaps the connector Cn2 and a portion of the carriage 120 on the +X direction side when viewed in the second direction D2. The third surface S3 does not abut on the carriage 120.

On the +X direction side of the lid member 290, the fourth surface S4 of the lid member 290 is disposed to cover the surfaces of the nozzle plate 280, the flow path forming member 270, and the vibration plate 260 on the +X direction side and a part of a surface of the case head 250 on the +X direction side. On the +X direction side of the lid member 290, the fifth surface S5 of the lid member 290 extends in the +X direction along the X axis, and is disposed on the first direction D1 side from the connector Cn4 provided on the first direction D1 side of the circuit board 230. An end portion of the fifth surface S5 on the +X direction side overlaps the connector Cn4 and a portion of the carriage 120 on the −X direction side when viewed in the second direction D2. Similar to the third surface S3, the fifth surface S5 does not abut on the carriage 120.

As illustrated in FIG. 7, the lid member 290 has two bent portions TP1 and TP2, and is formed by bending one member in the bent portions TP1 and TP2 in a predetermined direction. In detail, the first bent portion TP1 is a portion where an end portion of the first surface S1 on the third direction D3 side is bent in the second direction D2, and the first surface S1 and the second surface S2 are coupled to each other in the first bent portion TP1. The second bent portion TP2 is a portion where an end portion of the second surface S2 on the second direction D2 side is bent toward the third direction D3, and the second surface S2 and the third surface S3 are coupled to each other in the second bent portion TP2.

As illustrated in FIG. 8, an angle θ1 between the first surface S1 and the second surface S2 is 90 degrees. An "angle formed between the first surface S1 and the second surface S2" means an angle at which the first surface S1 and the second surface S2 are coupled to each other, and an inner angle of the first bent portion TP1 formed by bending the lid member 290. An angle θ2 between the second surface S2 and the third surface S3 is 90 degrees. An "angle formed between the second surface S2 and the third surface S3" means an angle at which the second surface S2 and the third surface S3 are coupled to each other, and an inner angle of the second bent portion TP2 formed by bending the lid member 290.

Although not illustrated in FIGS. 7 and 8, even on the +X direction side of the lid member 290, similar to the configuration of the lid member 290 on the −X direction side, the lid member 290 has two bent portions. As illustrated in FIG. 4 and FIG. 6, a bent portion is formed by bending, in the second direction D2, an end portion of the first surface S1 on the +X direction side, and the first surface S1 and the fourth surface S4 are coupled to each other in the bent portion. An angle formed between the first surface S1 and the fourth surface S4 is 90 degrees. Further, a bent portion is formed by bending, on the +X direction side, an end portion of the fourth surface S4 on the second direction D2 side, and the fourth surface S4 and the fifth surface S5 are coupled to each other in the bent portion. An angle formed between the fourth surface S4 and the fifth surface S5 is 90 degrees.

As illustrated in FIGS. 6 and 7, the carriage 120 includes protrusion portions PD1 and PD2 and side wall portions SW1 and SW2 in addition to the above-described bottom wall portions BW1 and BW2. All the bottom wall portions BW1 and BW2, the protrusion portions PD1 and PD2, and the side wall portions SW1 and SW2 function as a wall surface forming an outer wall of the carriage 120. The bottom wall portions BW1 and BW2 are arranged parallel to a direction along the X axis, and function as a bottom surface of the carriage 120. The bottom wall portions BW1 and BW2 may be arranged substantially parallel to the direction along the X axis.

The protrusion portion PD1 is a portion protruding toward the second direction D2 from an end portion of the bottom wall portion BW1 on the fourth direction D4 side. The protrusion portion PD2 is a portion protruding toward the second direction D2 from an end portion of the bottom wall portion BW2 on the third direction D3 side. The side wall portion SW1 is a portion protruding toward the second direction D2 from an end portion of the bottom wall portion BW1 on the third direction D3 side. The side wall portion SW2 is a portion protruding toward the second direction D2 from an end portion of the bottom wall portion BW2 on the fourth direction D4 side. The protrusion portions PD1 and PD2 and the side wall portions SW1 and SW2 function as side surfaces of the carriage 120. Although not illustrated, installation directions of the bottom wall portions, the protrusion portions, and the side wall portions of the carriage 120 are not limited to the +X direction and the −X direction of the liquid ejecting head 200, and may be, for example, the +Y direction, the −Y direction, and a direction intersecting the X direction and the Y direction. The bottom wall portions, the protrusion portions, and the side wall portions are provided to cover the periphery of the nozzle plate 280 when viewed in the second direction D2.

As illustrated in FIG. 8, the protrusion portion PD1 of the carriage 120 is disposed on the first direction D1 side from the third surface S3 of the lid member 290, and an end portion ES2 on the second direction D2 side is not in contact with the third surface S3. A minimum distance d1 between the end portion ES2 of the protrusion portion PD1 and the third surface S3 is, for example, 0.6 mm. Further, an end portion ES1 of the third surface S3 of the lid member 290 on the third direction D3 side overlaps the protrusion portion PD1 of the carriage 120 when viewed in the second direction D2.

As illustrated in FIG. 6, a part of the flexible flat cable 113 is accommodated in the carriage 120. In detail, on the −X direction side of the liquid ejecting head 200, a part of the flexible flat cable 113 is disposed to be surrounded by the side wall portion SW1 of the carriage 120, the liquid ejecting head 200, and the bottom wall portion BW1 of the carriage 120. Similarly, on the +X direction side of the liquid ejecting head 200, part of the flexible flat cable 113 is disposed to be surrounded by the side wall portion SW2 of the carriage 120, the liquid ejecting head 200, and the bottom wall portion BW2 of the carriage 120. The insertion port CP2 of the connector Cn2 is located in the third direction D3 rather than a portion where the outer wall of the carriage 120 and the third surface S3 overlap each other when viewed in the second direction D2. The insertion port CP4 of the connector Cn4 is located in the fourth direction D4 rather than a portion where the outer wall of the carriage 120 and the fifth surface S5 overlap each other when viewed in the second direction D2.

Figure 9:
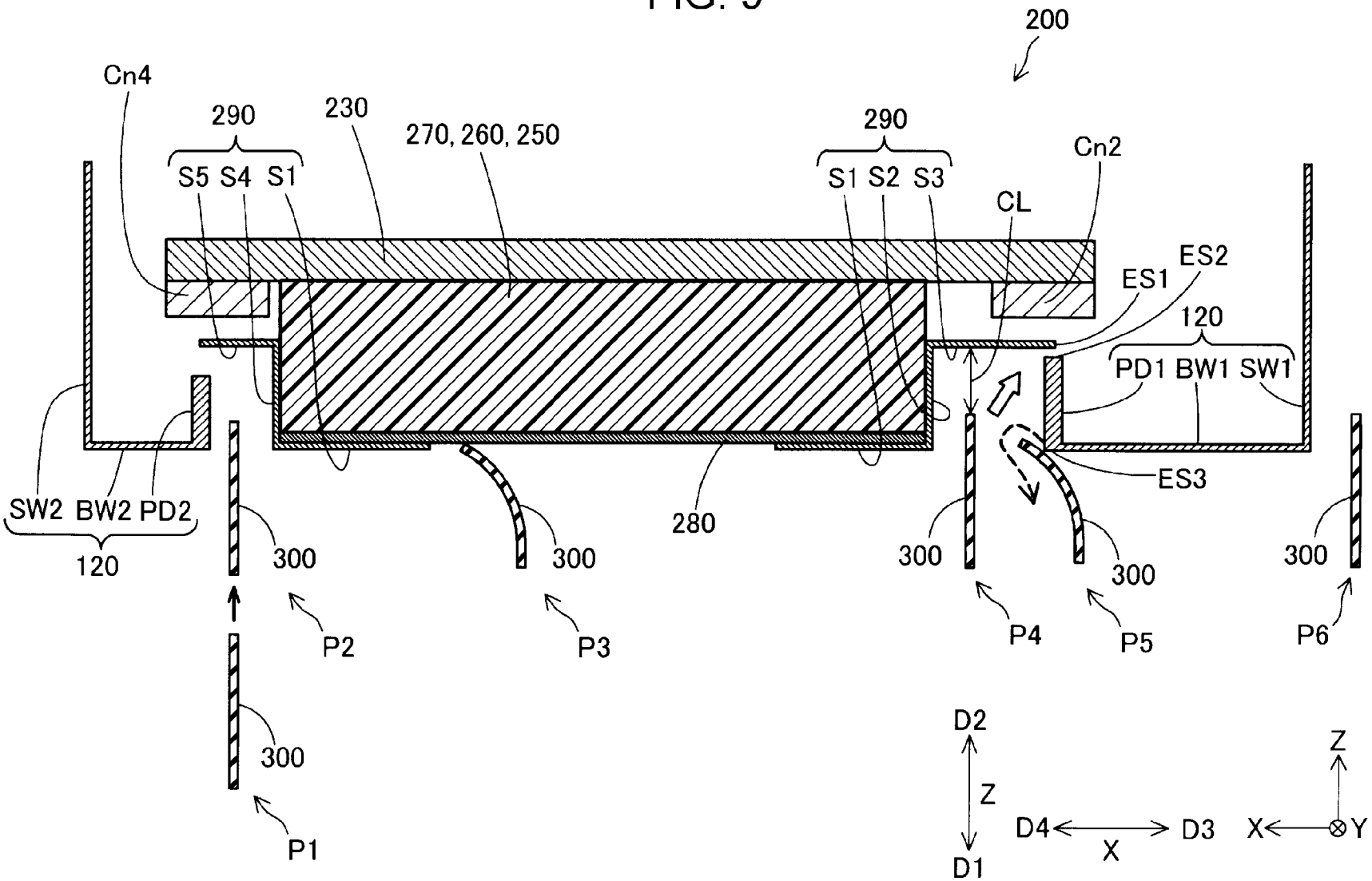
FIG. 9 is an explanatory view schematically illustrating a state of a wiping process.

A4. Wiping Process:

FIG. 9 is an explanatory view schematically illustrating a state of a wiping process. In the wiping process, the ink adhering to the surface of the nozzle plate 280 on the first direction D1 side is removed by a wiping member 300 included in the liquid ejecting apparatus 100. The adhesion of the ink to the nozzle plate 280 may occur, for example, when some of ink droplets discharged from the nozzle 282 become mist or when some of the ink droplets discharged from the nozzle 282 are bounced off from the printing medium P. As the amount of the ink adhering to the nozzle plate 280 increases, a possibility that a meniscus in the nozzle 282 is destroyed increases. As a result, poor ejection of the ink droplets occurs in the liquid ejecting head 200, thereby causing problems such as dot missing on the printing medium P. Therefore, in the liquid ejecting apparatus 100, a cleaning process such as the wiping process is executed according to an instruction from a user or an instruction from the control section 110.

In the present embodiment, the above-described wiping member 300 includes a wiper blade made of, for example, a soft resin such as rubber or elastomer. The wiping member 300 removes the ink adhering to the nozzle plate 280 by moving an end portion of the wiping member 300 in a direction along the X axis while contacting the surface of the nozzle plate 280 on the first direction D1 side. The wiping member 300 may be configured by an absorption member such as a cloth roller that absorbs and holds ink droplets.

When the wiping process is started, the wiping member 300 moves from a position P1 to a position P2 on the second direction D2 side by a drive mechanism that is not illustrated. At the position P2, an end portion of the wiping member 300 on the second direction D2 side is accommodated in a gap between the carriage 120 and the lid member 290, specifically, a space surrounded by the protrusion portion PD2 of the carriage 120, the fifth surface S5 of the lid member 290, and the fourth surface S4 of the lid member 290. At this time, a tip of the wiping member 300 on the +Z direction side does not contact the fifth surface S5 of the lid member 290. Thereafter, as illustrated in a position P3, the wiping member 300 moves relative to the liquid ejecting head 200 in the third direction D3. At this time, the drive mechanism brings the wiping member 300 into contact with the surface of the nozzle plate 280 on the first direction D1 side and moves the wiping member 300 in the third direction D3 in a slightly bent state. Accordingly, the ink adhering to the nozzle plate 280 is wiped off. As a method of moving the wiping member 300 in the direction along the X axis relative to the liquid ejecting head 200, the wiping member 300 may move in the −X direction with respect to the liquid ejecting head 200 and the liquid ejecting head 200 may move in the +X direction with respect to the wiping member 300.

When the wiping of the nozzle plate 280 is completed, the wiping member 300 moves to a position P4. The wiping member 300 returns from a state in which an end portion thereof on the second direction D2 side is bent to the same posture before the wiping is started, and the end portion of the wiping member 300 on the second direction D2 side is accommodated in the gap between the carriage 120 and the lid member 290, specifically, a space surrounded by the second surface S2 of the lid member 290, the third surface S3 of the lid member 290, and the protrusion portion PD1 of the carriage 120. In the present embodiment, a clearance CL is formed between a tip of the wiping member 300 on the second direction D2 side and the third surface S3 of the lid member 290, and the wiping member 300 is not in contact with the third surface S3 of the lid member 290. The size of the clearance CL is, for example, 1 mm or more. The size of the clearance CL is not limited to 1 mm or more, and may be a predetermined other size. Further, the clearance CL may be omitted, and the wiping member 300 may contact the third surface S3 of the lid member 290.

As the posture of the wiping member 300 at the position P4 returns to the state before the wiping process is started, the ink droplets adhering to the wiping member 300 are scattered on the third surface S3 of the lid member 290 and the protrusion portion PD1 side of the carriage 120, as indicated by a white arrow. As described above, in the present embodiment, the third surface S3 of the lid member 290 overlaps the protrusion portion PD1 of the carriage 120 when viewed in the second direction D2. Therefore, even when the ink droplets are scattered on the third surface S3 and the protrusion portion PD1 side, the ink droplets can be suppressed from entering the carriage 120 through a gap between the third surface S3 and the protrusion portion PD1.

At a position P5, the wiping member 300 comes into contact with an end portion ES3 of the protrusion portion PD1 of the carriage 120 on the first direction D1 side, and the ink droplets adhering to the wiping member 300 flow toward the first direction D1 side, as indicated by a broken line arrow. The wiping member 300 moves in the third direction D3 while being in contact with the bottom wall portion BW1 of the carriage 120. As the wiping member 300 moves to a position P6 located in the third direction D3 from the side wall portion SW1 of the carriage 120, the contact with the bottom wall portion BW1 of the carriage 120 is released, and the wiping process is terminated.

According to the above-described liquid ejecting apparatus 100 of the first embodiment, the third surface S3 of the lid member 290 is coupled to the second surface S2 of the lid member 290, extends in the third direction D3, and is disposed so as not to abut on the protrusion portion PD1 of the carriage 120, and the end portion ES1 of the third surface S3 on the third direction D3 side overlaps the protrusion portion PD1 of the carriage 120 when viewed in the second direction D2. Therefore, it is possible to suppress the ink from entering the inside of the carriage 120 via the gap between the lid member 290 and the carriage 120. In addition, since the third surface S3 of the lid member 290 and the protrusion portion PD1 of the carriage 120 are not in contact with each other, a stress caused by peeling of the lid member 290 from the liquid ejecting head 200 can be suppressed from being applied to the third surface S3.

Since the third surface S3 is disposed in the first direction D1 from the connector Cn2, it is possible to suppress the ink from adhering to the connector Cn2.

The outer wall of the carriage 120 is located in the first direction D1 from the third surface S3, and the outer wall has the bottom wall portion BW1 and the protrusion portion PD1 protruding from the bottom wall portion BW1 to the third surface S3. Therefore, even when the ink droplets are scattered on the carriage 120 side, it is possible to suppress the ink droplets from entering the inside of the carriage 120.

Since the angle θ1 between the first surface S1 and the second surface S2 is 90 degrees, the lid member 290 and the case head 250 can be easily positioned. In addition, since the angle θ2 between the second surface S2 and the third surface S3 is 90 degrees, the lid member 290 can be easily manufactured.

Since a minimum distance d1 between the protrusion portion PD1 and the third surface S3 in the first direction D1 is 1 mm or less in a portion where the protrusion portion PD1 and the third surface S3 overlap each other when viewed in the second direction D2, the gap between the protrusion portion PD1 and the third surface S3 can be made smaller. Therefore, it is possible to suppress the ink from entering the inside of the carriage 120 via a gap between the third surface S3 and the carriage 120. The minimum distance d1 may be a predetermined distance of 0.2 mm or more and 1 mm or less instead of 0.6 mm, and the smaller the minimum distance d1, the better. As the minimum distance d1 is smaller, it is possible to suppress the ink from entering the inside of the carriage 120 via the gap between the third surface S3 and the carriage 120.

Since the wiping member 300 that wipes the surface of the nozzle plate 280 on the first direction D1 side is provided, the ink droplets adhering to the nozzle plate 280 can be easily wiped off, as compared to a configuration in which the wiping member 300 is not provided. As a result, in the liquid ejecting apparatus 100, it is possible to suppress the occurrence of defects caused by the ink adhering to the nozzle plate 280.

Since the wiping member 300 moves relative to the liquid ejecting head 200 in the third direction D3 while contacting the surface of the nozzle plate 280 on the first direction D1 side, the third surface S3 of the lid member 290 exists along the movement direction of the wiping member 300, and even if the ink droplets are scattered when the nozzle plate 280 is wiped, it is possible to suppress the ink droplets from entering the inside of the carriage 120 by such a third surface S3.

Since the nozzle rows 281 are arranged side by side along the third direction D3, the movement direction of the wiping member 300 and the arrangement direction of the nozzle rows 281 can be the same direction. Therefore, the wiping member 300 can be downsized. Further, the movement direction of the wiping member 300 and the scanning direction of the carriage 120 can be the same direction. Therefore, the nozzle plate 280 can be wiped by the wiping member 300 by scanning the carriage 120.

Since the wiping member 300 does not contact the third surface S3, the wiping member 300 can be accommodated in a region between the lid member 290 and the carriage 120. Therefore, the liquid ejecting apparatus 100 can be downsized.

Since the clearance CL of 1 mm or more is formed between a tip of the wiping member 300 in the second direction D2 and the third surface S3, it is possible to suppress the ink adhering to the tip of the wiping member 300 from adhering to the third surface S3.

Since the insertion port CP2 of the connector Cn2 is located in the third direction D3 from a portion where the outer wall of the carriage 120 and the third surface S3 overlap each other when viewed in the second direction D2, the insertion port CP2 can be moved away from a gap between the outer wall of the carriage 120 and the third surface S3, and the ink can be suppressed from adhering to the insertion port CP2 of the connector Cn2.

B. Second Embodiment

Figure 10:
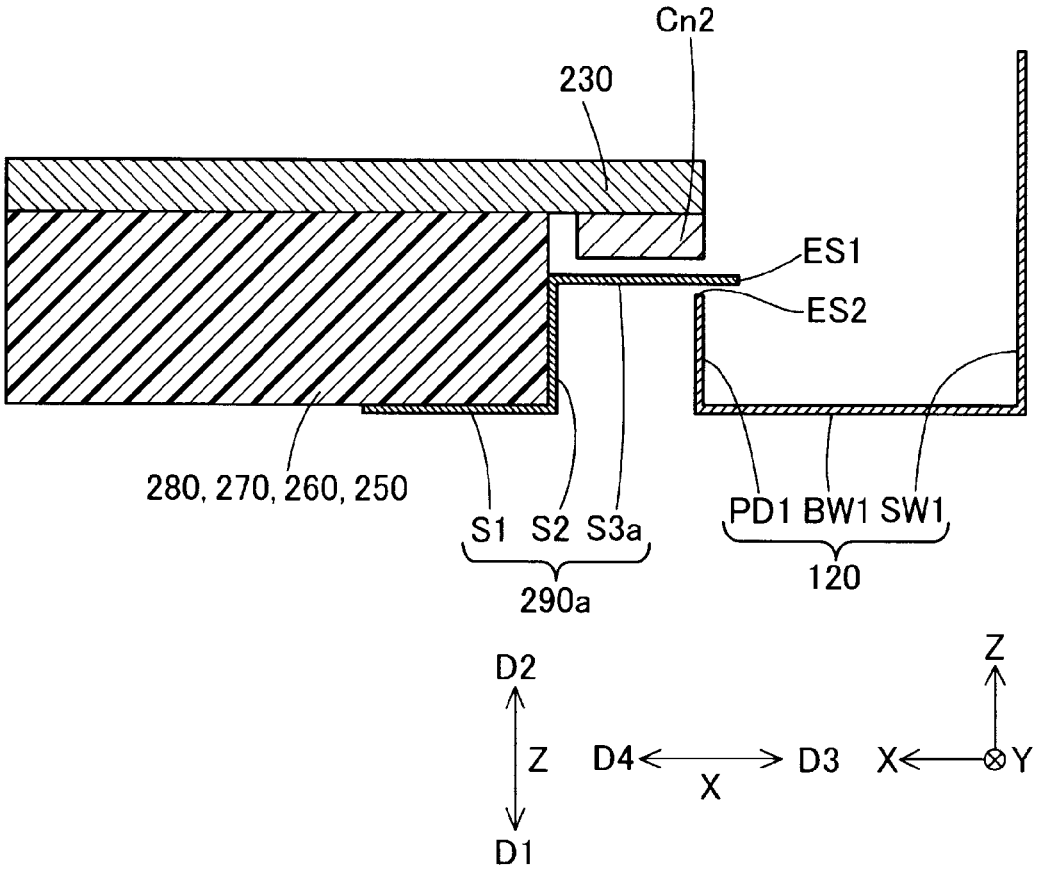
FIG. 10 is an explanatory view illustrating an arrangement configuration of a lid member and a carriage according to a second embodiment.

Hereinafter, the same components as those in the above-described first embodiment will be designated by the same reference numerals, and description thereof will be omitted. FIG. 10 is an explanatory view illustrating an arrangement configuration of a lid member 290*a* and the carriage 120 included in the liquid ejecting apparatus according to a second embodiment. In FIG. 10, a region corresponding to the region VII illustrated in FIG. 7 is illustrated. The same manner is applied to the drawings referred to below. The liquid ejecting apparatus according to the second embodiment is different from the liquid ejecting apparatus 100 according to the first embodiment in that the lid member 290*a* is provided instead of the lid member 290. The lid member 290*a* according to the second embodiment is different from the lid member 290 of the first embodiment in that a third surface S3*a* is provided instead of the third surface S3.

The third surface S3*a* is disposed on the first direction D1 side of the connector Cn2, and the entire area of the connector Cn2 in the direction along the X axis overlaps the third surface S3*a* when viewed in the second direction D2.

The end portion ES1 of the third surface S3*a* on the third direction D3 side is located on the third direction D3 side from an end portion of the connector Cn2 on the third direction D3 side. The end portion ES1 of the third surface S3*a* overlaps the bottom wall portion BW1 when viewed in the second direction D2. The position of the end portion ES1 of the third surface S3*a* is not limited to the example illustrated in FIG. 10, and the end portion ES1 is disposed at a position on the third direction D3 side as compared to a position of the end portion of the connector Cn2 on the third direction D3 side, so that it is possible to suppress the ink from entering the inside of the carriage 120.

According to the above-described liquid ejecting apparatus of the second embodiment, since the third surface S3*a* overlaps the connector Cn2 when viewed in the second direction D2, it is possible to further suppress the ink from adhering to the connector Cn2.

C. Third Embodiment

Figure 11:
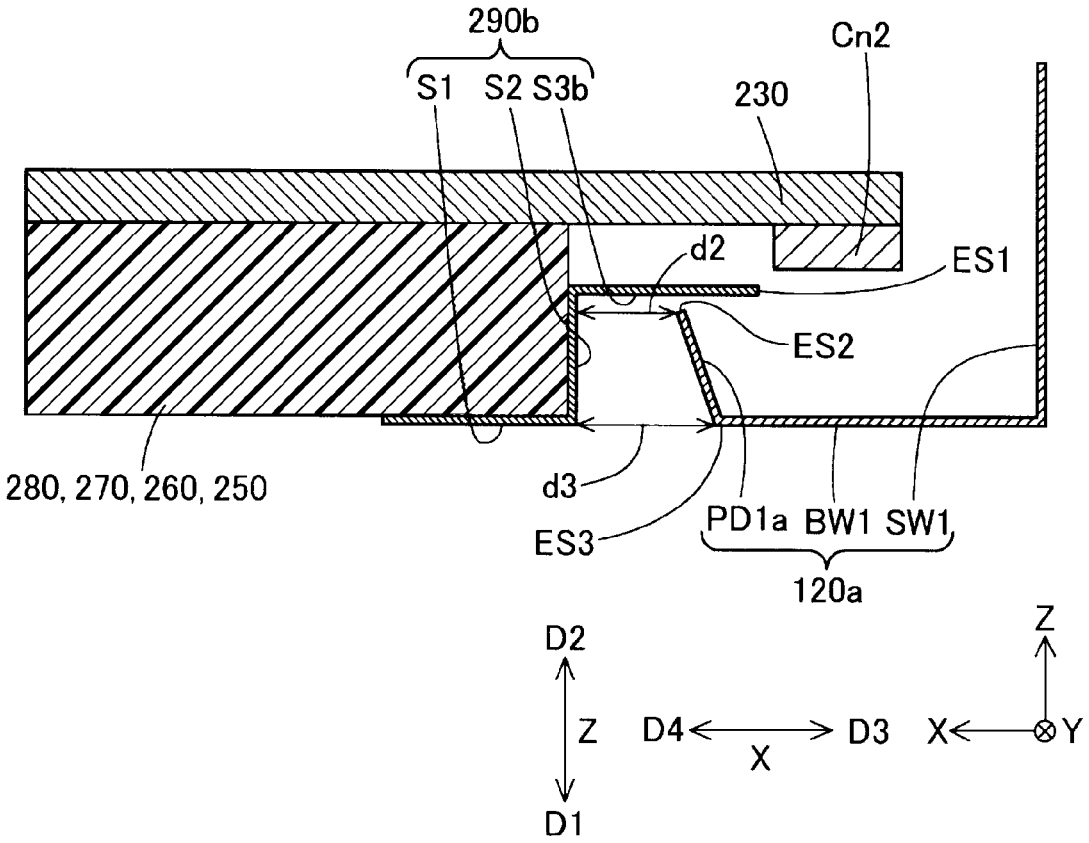
FIG. 11 is an explanatory view illustrating an arrangement configuration of a lid member and a carriage according to a third embodiment.

FIG. 11 is an explanatory view illustrating an arrangement configuration of a lid member 290*b* and a carriage 120*a* included in the liquid ejecting apparatus according to the third embodiment. The liquid ejecting apparatus according to the third embodiment differs from the liquid ejecting apparatus 100 according to the first embodiment in that the lid member 290*b* is provided instead of the lid member 290 and the carriage 120*a* is provided instead of the carriage 120. The lid member 290*b* of the third embodiment differs from the lid member 290 of the first embodiment in that a third surface S3*b* is provided instead of the third surface S3. The carriage 120*a* according to the third embodiment differs from the carriage 120 according to the first embodiment in that a protrusion portion PD1*a* is provided instead of the protrusion portion PD1.

Similar to the third surface S3 of the first embodiment, the third surface S3*b* is disposed on the first direction D1 side from the connector Cn2, but does not overlap the connector Cn2 when viewed in the second direction D2. Therefore, the end portion ES1 of the third surface S3*b* on the third direction D3 side is disposed on the fourth direction D4 side from the end portion of the connector Cn2 on the fourth direction D4 side.

The protrusion portion PD1*a* protrudes toward the third surface S3*b*. In detail, the protrusion portion PD1*a* protrudes from the third surface S3*b* in the fourth direction D4 side, that is, in a direction intersecting the second direction D2 and the fourth direction D4. A distance d2 between the end portion ES2 of the protrusion portion PD1*a* on the second direction D2 side and the second surface S2 is smaller than a distance d3 between the end portion ES3 of the protrusion portion PD1*a* on the first direction D1 side and the second surface S2. In other words, the end portion ES2 of the protrusion portion PD1*a* on the second direction D2 side is disposed on the second surface S2 side as compared with the end portion ES3 of the protrusion portion PD1*a* on the first direction D1 side. Therefore, a gap between the third surface S3*b* and the end portion ES2 of the protrusion portion PD1*a* exists at a position farther from the connector Cn2. The end portion ES1 of the third surface S3*b* on the third direction D3 side overlaps the bottom wall portion BW1 when viewed in the second direction D2.

According to the above-described liquid ejecting apparatus of the third embodiment, the outer wall of the carriage 120*a* has the bottom wall portion BW1 and the protrusion portion PD1*a* that protrudes from the bottom wall portion BW1 to the third surface S3*b*. Thus, even when the ink droplets are scattered on a side of the carriage 120*a*, it is possible to suppress such ink droplets from entering the inside of the carriage 120*a*.

In the third direction D3, since the distance d2 between the end portion ES1 of the protrusion portion PD1*a* on the second direction D2 side and the second surface S2 is smaller than the distance d3 between the end portion ES3 of the protrusion portion PD1*a* on the first direction D1 side and the second surface S2, it is possible to suppress the ink droplets from adhering to the third surface S3*b*. Therefore, it is possible to further suppress the ink from entering the inside of the carriage 120*a* via a gap between the lid member 290*b* and the carriage 120*a*.

In the third embodiment, the end portion ES1 of the third surface S3*b* on the third direction D3 side may not overlap the bottom wall portion BW1 but may overlap the protrusion portion PD1*a* when viewed in the second direction D2.

D. Fourth Embodiment

Figure 12:
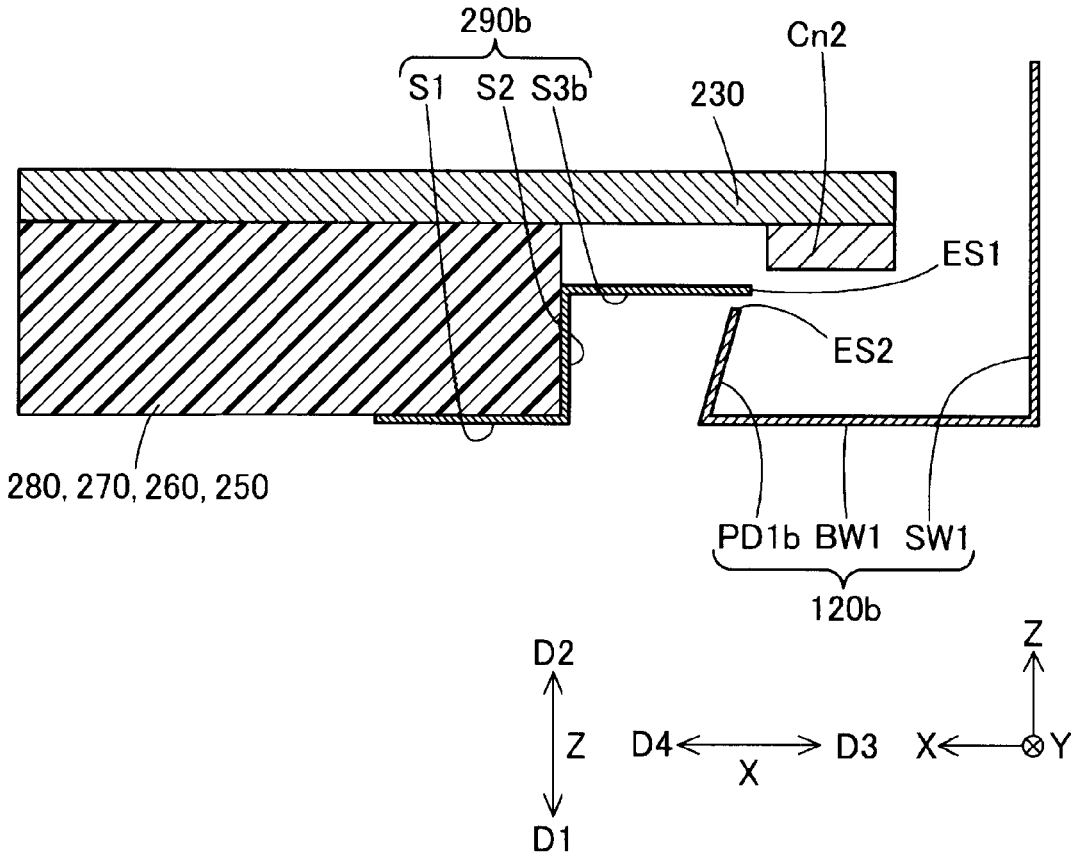
FIG. 12 is an explanatory view illustrating an arrangement configuration of a lid member and a carriage according to a fourth embodiment.

FIG. 12 is an explanatory view illustrating an arrangement configuration of the lid member 290*b* and a carriage 120*b* included in the liquid ejecting apparatus according to a fourth embodiment. The liquid ejecting apparatus according to the fourth embodiment differs from the liquid ejecting apparatus according to the third embodiment in that the carriage 120*b* is provided instead of the carriage 120*a*. The carriage 120*b* of the fourth embodiment differs from the carriage 120*a* of the third embodiment in that a protrusion portion PD1*b* is provided instead of the protrusion portion PD1*a*.

The protrusion portion PD1*b* protrudes toward the end portion ES1 of the third surface S3*b* on the third direction D3 side. That is, the protrusion portion PD1*b* protrudes in a direction intersecting the second direction D2 and the third direction D3. The end portion ES1 of the third surface S3*b* on the third direction D3 side overlaps the bottom wall portion BW1 when viewed in the second direction D2. Further, the end portion ES1 of the third surface S3*b* on the third direction D3 side also overlaps the end portion ES2 of the protrusion portion PD1*b* on the second direction D2 side when viewed in the second direction D2.

According to the above-described liquid ejecting apparatus of the fourth embodiment, the same effect as that of the third embodiment can be obtained.

E. Fifth Embodiment

Figure 13:
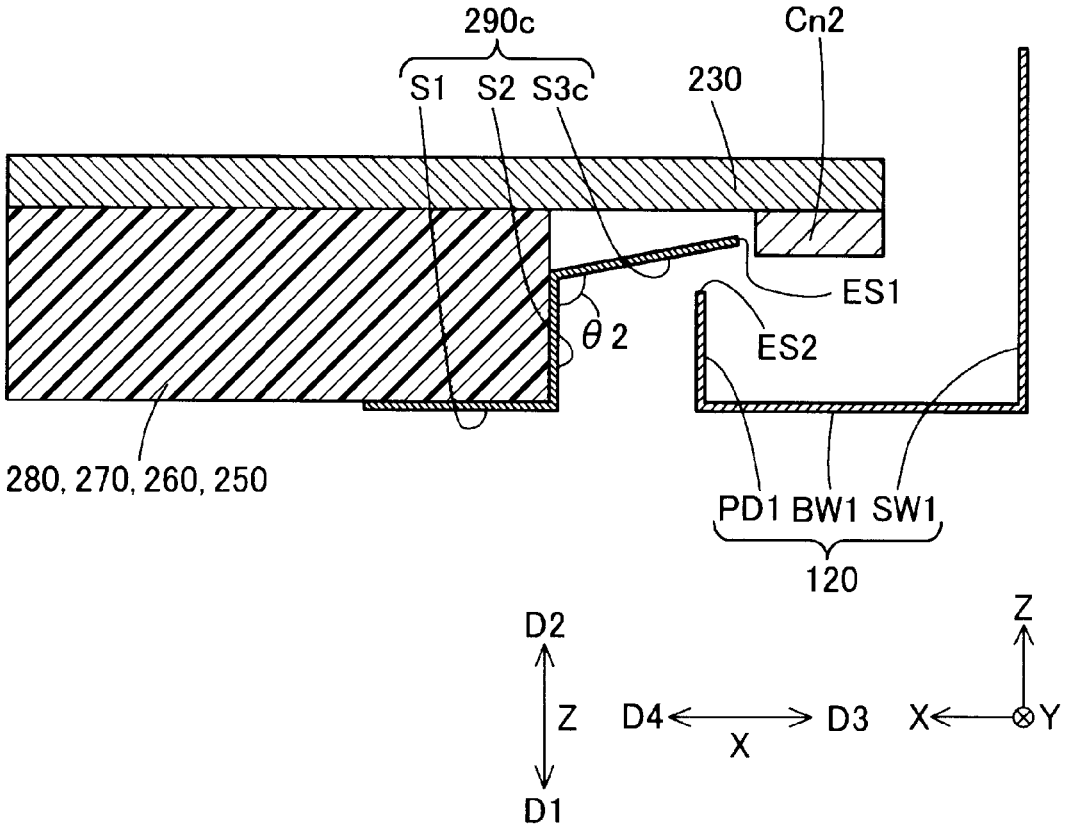
FIG. 13 is an explanatory view illustrating an arrangement configuration of a lid member and a carriage according to a fifth embodiment.

FIG. 13 is an explanatory view illustrating an arrangement configuration of a lid member 290*c* and the carriage 120 included in the liquid ejecting apparatus according to the fifth embodiment. The liquid ejecting apparatus of the fifth embodiment differs from the liquid ejecting apparatus of the third embodiment in that the lid member 290*c* is provided instead of the lid member 290*b* and the carriage 120 is provided instead of the carriage 120*a*. The lid member 290*c* of the fifth embodiment differs from the lid member 290*b* of the third embodiment in that a third surface S3*c* is provided instead of the third surface S3*b*. The carriage 120 of the fifth embodiment is the same as that of the first embodiment.

The third surface S3*c* extends toward the connector Cn2. In detail, the third surface S3*c* extends along the direction intersecting the second direction D2 and the third direction D3, and the end portion ES1 of the third surface S3*c* on the third direction D3 side is disposed on the second direction D2 side from a surface of the connector Cn2 on the first direction D1 side. In the present embodiment, the angle θ2 between the second surface S2 and the third surface S3*c* is 90 degrees or more, for example, 120 degrees. The angle θ2 between the second surface S2 and the third surface S3*c* may be a predetermined other angle such as 135 degrees and 150 degrees, which is equal to or larger than 90 degrees and equal to or smaller than 180 degrees, instead of 120 degrees. When viewed in the second direction D2, the end portion ES1 of the third surface S3*c* does not overlap the connector Cn2, but overlaps the bottom wall portion BW1 of the carriage 120.

According to the above-described liquid ejecting apparatus of the fifth embodiment, the angle θ2 between the second surface S2 and the third surface S3*c* is 90 degrees or more. Thus, even when the ink adheres to the third surface S3*c*, it is possible to suppress the ink adhering to the third surface S3*c* from moving to the carriage 120 side due to gravity, as a compared to the configuration in which the angle θ2 between the second surface S2 and the third surface S3*c* is less than 90 degrees. Therefore, it is possible to further suppress the ink from entering the inside of the carriage 120 via a gap between the lid member 290*c* and the carriage 120.

In the fifth embodiment, the end portion ES1 of the third surface S3*c* on the third direction D3 side may be disposed on the first direction D1 side from the surface of the connector Cn2 on the first direction D1 side. Further, the end portion ES1 of the third surface S3*c* may overlap the connector Cn2 when viewed in the second direction D2.

F. Sixth Embodiment

Figure 14:
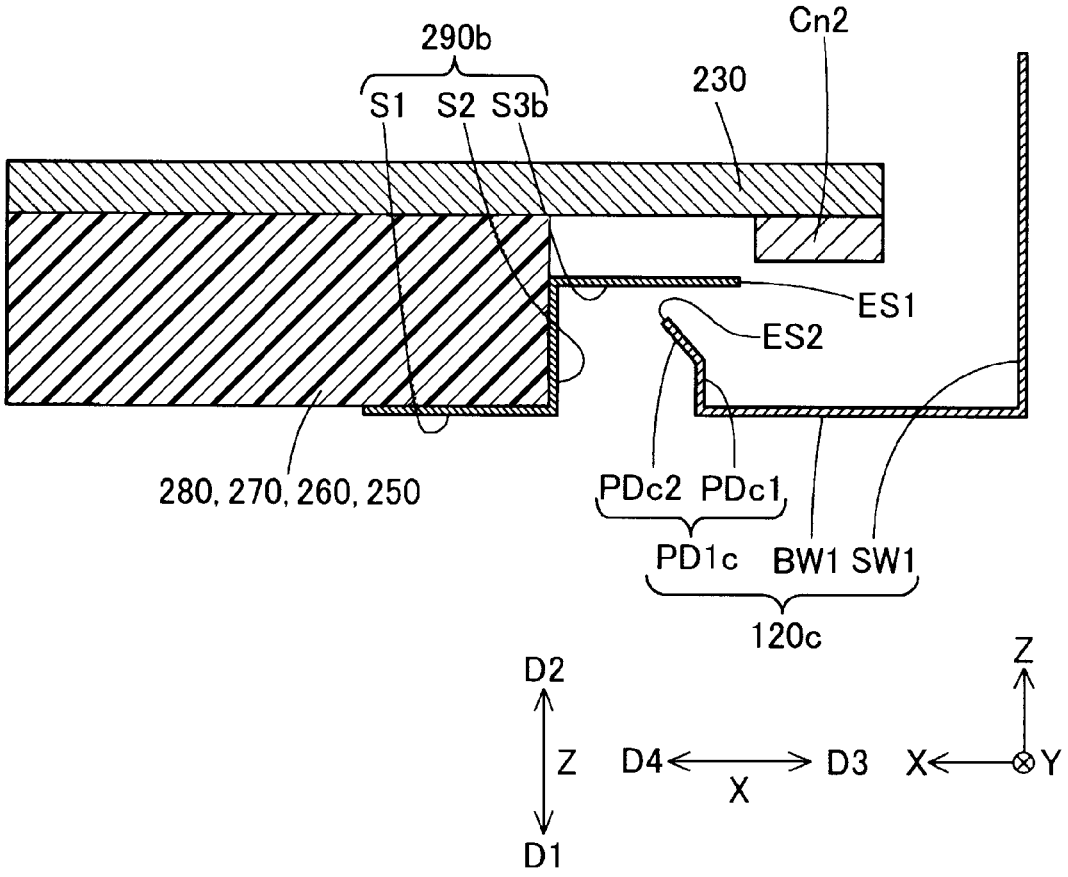
FIG. 14 is an explanatory view illustrating an arrangement configuration of a lid member and a carriage according to a sixth embodiment.

FIG. 14 is an explanatory view illustrating an arrangement configuration of the lid member 290*b* and a carriage

120*c* included in the liquid ejecting apparatus according to a sixth embodiment. The liquid ejecting apparatus of the sixth embodiment differs from the liquid ejecting apparatus of the third embodiment in that the carriage 120*c* is provided instead of the carriage 120*a*. The carriage 120*c* of the sixth embodiment differs from the carriage 120*a* of the third embodiment in that a protrusion portion PD1*c* is provided instead of the protrusion portion PD1*a*.

The protrusion portion PD1*c* has a first protrusion portion PDc1 and a second protrusion portion PDc2. The first protrusion portion PDc1 is a portion protruding from the bottom wall portion BW1 in the second direction D2. The second protrusion portion PDc2 is a portion protruding from the first protrusion portion PDc1 to the third surface S3*b* on the fourth direction D4 side, more accurately, in the direction intersecting the second direction D2 and the fourth direction D4. The end portion ES1 of the third surface S3*b* on the third direction D3 side overlaps the bottom wall portion BW1 when viewed in the second direction D2.

According to the above-described liquid ejecting apparatus of the sixth embodiment, the protrusion portion PD1*c* has the first protrusion portion PDc1 protruding from the bottom wall portion BW1 in the second direction D2 and the second protrusion portion PDc2 protruding from the first protrusion portion PDc1 in the fourth direction D4, and the third surface S3*b* overlaps the second protrusion portion PDc2 when viewed in the second direction D2. Thus, even when the ink droplets are scattered on the carriage 120*c* side, it is possible to suppress the ink droplets from entering the inside of the carriage 120*c*.

In the sixth embodiment, the end portion ES1 of the third surface S3*b* on the third direction D3 side does not overlap the bottom wall portion BW1 when viewed in the second direction D2, and may overlap the second protrusion portion PDc2.

The number of the protrusion parts of the protrusion portion PD1*c* is not limited to two, and the protrusion portion PD1*c* may be formed to protrude in multiple stages such as three or more stages.

G. Seventh Embodiment

Figure 15:
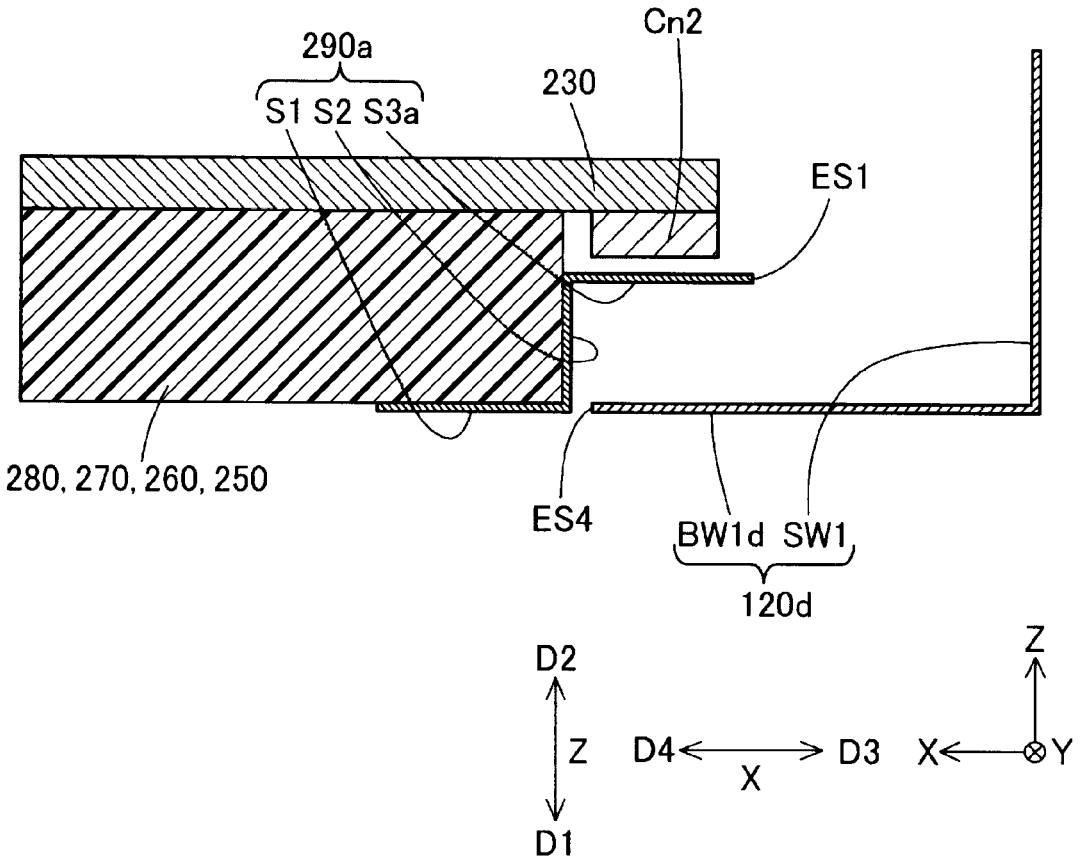
FIG. 15 is an explanatory view illustrating an arrangement configuration of a lid member and a carriage according to a seventh embodiment.

FIG. 15 is an explanatory view illustrating an arrangement configuration of the lid member 290*a* and a carriage 120*d* included in the liquid ejecting apparatus according to a seventh embodiment. The liquid ejecting apparatus according to the seventh embodiment differs from the liquid ejecting apparatus according to the second embodiment in that the carriage 120*d* is provided instead of the carriage 120. The carriage 120*d* of the seventh embodiment differs from the carriage 120 of the second embodiment in that the protrusion portion PD1 is omitted and a bottom wall portion BW1*d* is provided instead of the bottom wall portion BW1.

The bottom wall portion BW1*d* extends toward the fourth direction D4 side as compared with the bottom wall portion BW1 of the second embodiment. An end portion ES4 of the bottom wall portion BW1*d* on the fourth direction D4 side overlaps an end portion of the connector Cn2 on the fourth direction D4 side when viewed in the second direction D2. The end portion ES1 of the third surface S3*a* of the lid member 290*a* on the third direction D3 side overlaps the bottom wall portion BW1*d* when viewed in the second direction D2.

Therefore, a region where the third surface S3*a* and the bottom wall portion BW1*d* overlap each other can be made larger.

According to the above-described liquid ejecting apparatus of the seventh embodiment, since the region in which the third surface S3*a* of the lid member 290*a* and the bottom wall portion BW1*d* of the carriage 120*d* overlap each other when viewed in the second direction D2 can be made larger, it is possible to further suppress the ink from entering the inside of the carriage 120*d* via the gap between the lid member 290*a* and the carriage 120*d*.

In the seventh embodiment, the end portion ES4 of the bottom wall portion BW1*d* on the fourth direction D4 side may not overlap the end portion of the connector Cn2 on the fourth direction D4 side when viewed in the second direction D2.

H. Eighth Embodiment

Figure 16:
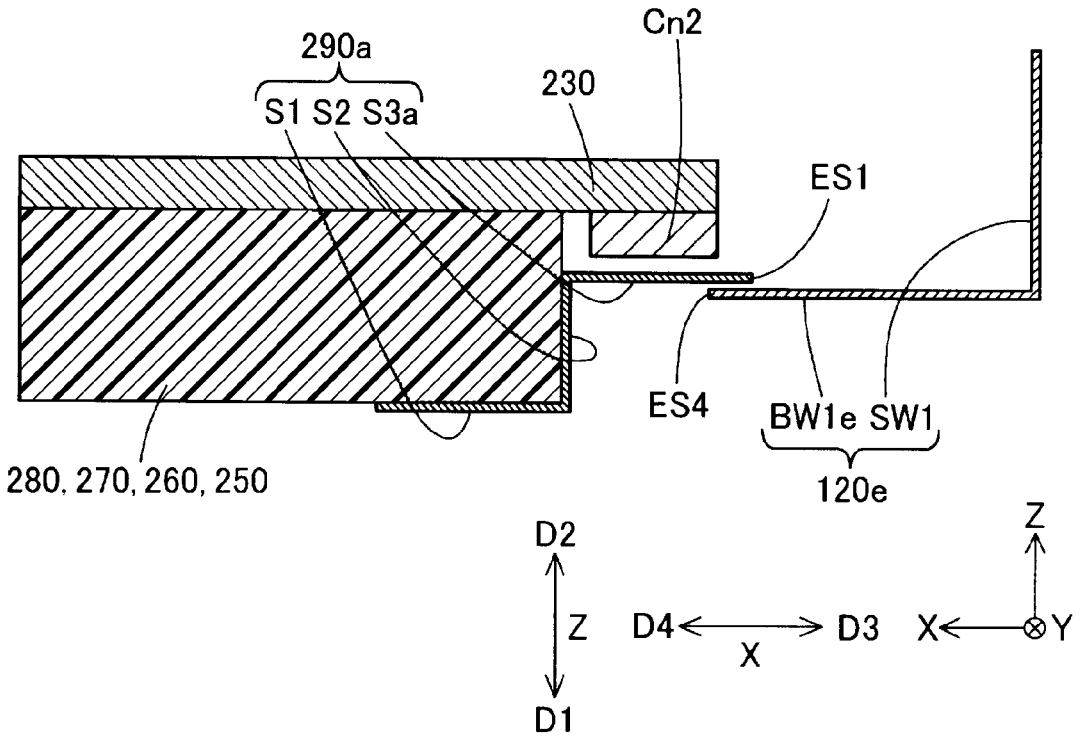
FIG. 16 is an explanatory view illustrating an arrangement configuration of a lid member and a carriage according to an eighth embodiment.

FIG. 16 is an explanatory view illustrating an arrangement configuration of the lid member 290*a* and a carriage 120*e* included in the liquid ejecting apparatus according to the eighth embodiment. The liquid ejecting apparatus according to the eighth embodiment differs from the liquid ejecting apparatus according to the seventh embodiment in that a carriage 120*e* is provided instead of the carriage 120*d*. The carriage 120*e* of the seventh embodiment differs from the carriage 120*d* of the seventh embodiment in that a bottom wall portion BW1*e* is provided instead of the bottom wall portion BW1*d*.

The bottom wall portion BW1*e* does not extend to the fourth direction D4 side as compared with the bottom wall portion BW1*d* of the seventh embodiment. In detail, the end portion ES4 of the bottom wall portion BW1*e* on the fourth direction D4 side is disposed at a position overlapping the end portion of the connector Cn2 on the third direction D3 side when viewed in the second direction D2, and does not extend to a position overlapping the end portion of the connector Cn2 on the fourth direction D4 side. Further, the bottom wall portion BW1*e* has a smaller distance to the third surface S3*a* in the Z direction than that of the bottom wall portion BW1*d* of the seventh embodiment. The end portion ES1 of the third surface S3*a* of the lid member 290*a* on the third direction D3 side overlaps the bottom wall portion BW1*e* when viewed in the second direction D2.

According to the above-described liquid ejecting apparatus according to the eighth embodiment, when viewed in the second direction D2, the third surface S3*a* and the bottom wall portion BW1*d* overlap each other, and a distance between the third surface S3*a* and the bottom wall portion BW1*e* in the Z direction is smaller. Thus, it is possible to further suppress the ink from entering the inside of the carriage 120*e* via the gap between the lid member 290*a* and the carriage 120*e*.

In the eighth embodiment, the end portion ES4 of the bottom wall portion BW1*e* on the fourth direction D4 side may not be disposed at a position overlapping the end portion of the connector Cn2 on the third direction D3 side when viewed in the second direction D2, and may extend to a position overlapping the end portion of the connector Cn2 on the fourth direction D4 side.

I. Ninth Embodiment

Figure 17:
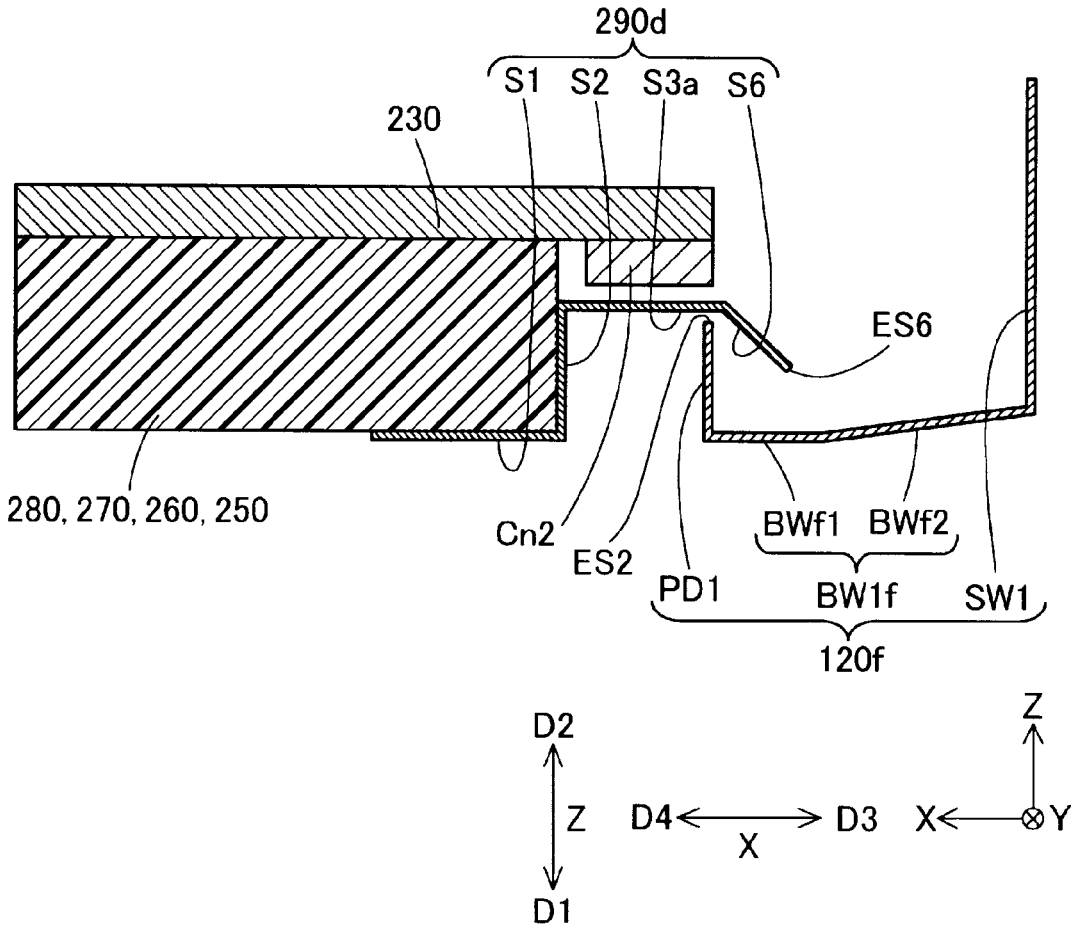
FIG. 17 is an explanatory view illustrating an arrangement configuration of a lid member and a carriage according to a ninth embodiment.

FIG. 17 is an explanatory view illustrating an arrangement configuration of a lid member 290*d* and a carriage 120*f* included in the liquid ejecting apparatus according to a ninth embodiment. The liquid ejecting apparatus according to the ninth embodiment differs from the liquid ejecting apparatus according to the second embodiment in that a lid member

290*d* is provided instead of the lid member 290*a* and a carriage 120*f* is provided instead of the carriage 120. The lid member 290*d* of the ninth embodiment differs from the lid member 290*a* of the second embodiment in that a sixth surface S6 is additionally provided. The carriage 120*f* of the ninth embodiment differs from the carriage 120 of the second embodiment in that a bottom wall portion BW1*f* is provided instead of the bottom wall portion BW1.

The sixth surface S6 extends from an end portion of the third surface S3*a* on the third direction D3 side to the bottom wall portion BW1*f* of the carriage 120*f*, more accurately, in a direction intersecting the first direction D1 and the third direction D3. The bottom wall portion BW1*f* has a first bottom wall portion BWf1 and a second bottom wall portion BWf2. The first bottom wall portion BWf1 is a portion that extends along the X axis on the protrusion portion PD1 side in the bottom wall portion BW1*f*. The second bottom wall portion BWf2 is a portion extending from the end portion of the first bottom wall portion BWf1 on the third direction D3 side on the side wall portion SW1 side in the bottom wall portion BW1*f* toward an end portion of the side wall portion SW1 on the first direction D1 side. The second bottom wall portion BWf2 is inclined toward the side wall portion SW1, more accurately, in the direction intersecting the second direction D2 and the third direction D3. An end portion ES6 of the sixth surface S6 of the lid member 290*d* on the third direction D3 side overlaps the first bottom wall portion BWf1 when viewed in the second direction D2. That is, the sixth surface S6 overlaps the bottom wall portion BWf1 when viewed in the second direction D2.

According to the above-described liquid ejecting apparatus of the ninth embodiment, since the third surface S3*a* overlaps the first bottom wall portion BWf1 when viewed in the second direction D2, and the lid member 290*d* includes the sixth surface S6 that extends from the third surface S3*a* to the first bottom wall portion BWf1, it is possible to suppress the ink from entering the inside of the carriage 120*f* via the gap between the lid member 290*d* and the carriage 120*f*.

Further, the second bottom wall portion BWf2 of the carriage 120*f* is inclined toward the direction intersecting the second direction D2 and the third direction D3, so that when the wiping process is terminated, the contact between the wiping member 300 and the bottom wall portion BW1*f* of the carriage 120 is released, and thus when the wiping member 300 is separated from the bottom wall portion BW1*f*, it is possible to suppress the ink from being scattered.

J. Tenth Embodiment

Figure 18:
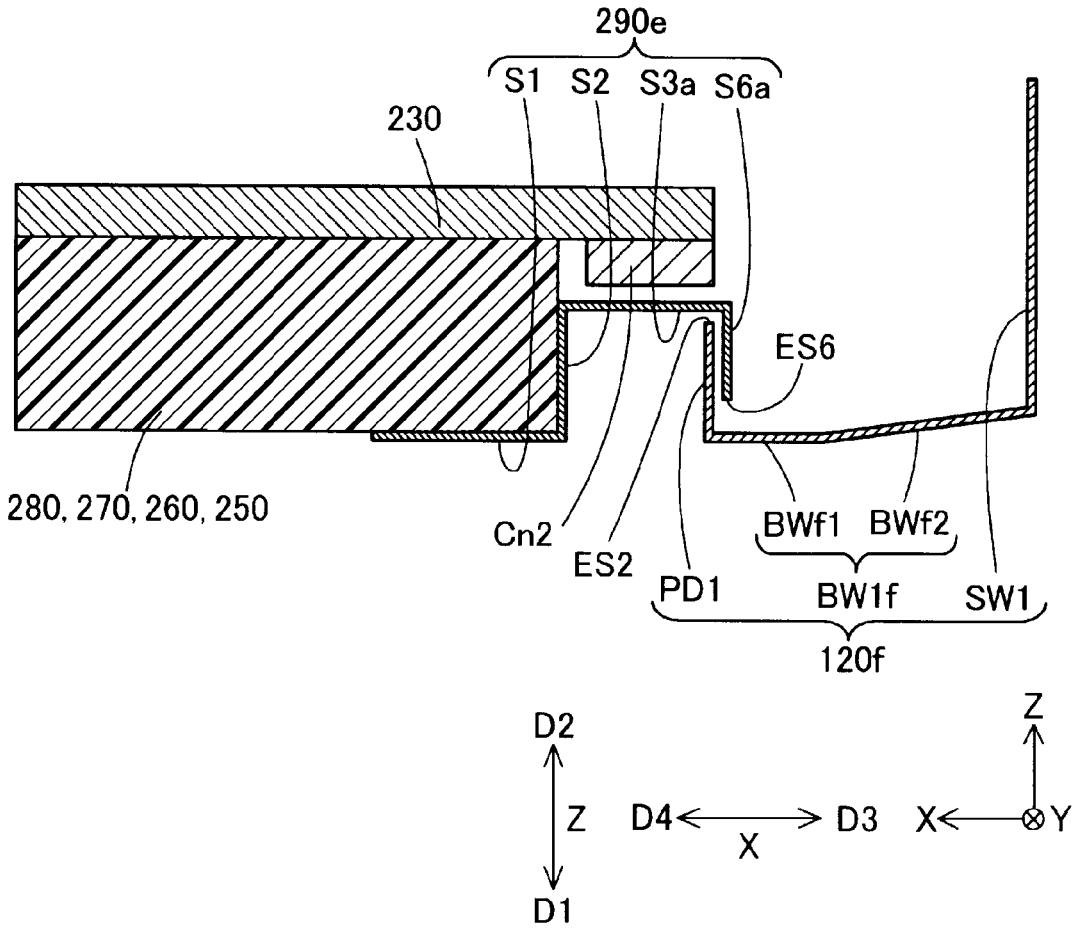
FIG. 18 is an explanatory view illustrating an arrangement configuration of a lid member and a carriage according to a tenth embodiment.

FIG. 18 is an explanatory view illustrating an arrangement configuration of a lid member 290*e* and the carriage 120*f* included in the liquid ejecting apparatus according to a tenth embodiment. The liquid ejecting apparatus according to the tenth embodiment differs from the liquid ejecting apparatus according to the ninth embodiment in that a lid member 290*e* is provided instead of the lid member 290*d*. The lid member 290*e* of the tenth embodiment differs from the lid member 290*d* of the ninth embodiment in that a sixth surface S6*a* is provided instead of the sixth surface S6.

The sixth surface S6*a* extends in the first direction D1 from the end portion of the third surface S3*a* on the third direction D3 side. The sixth surface S6*a* is disposed on the third direction D3 side from the protrusion portion PD1 of the carriage 120*f* in the X direction. The sixth surface S6*a* overlaps the first bottom wall portion BWf1 of the carriage 120*f* when viewed in the second direction D2.

According to the above-described liquid ejecting apparatus of the tenth embodiment, the same effect as that of the ninth embodiment can be obtained.

K. Eleventh Embodiment

Figure 19:
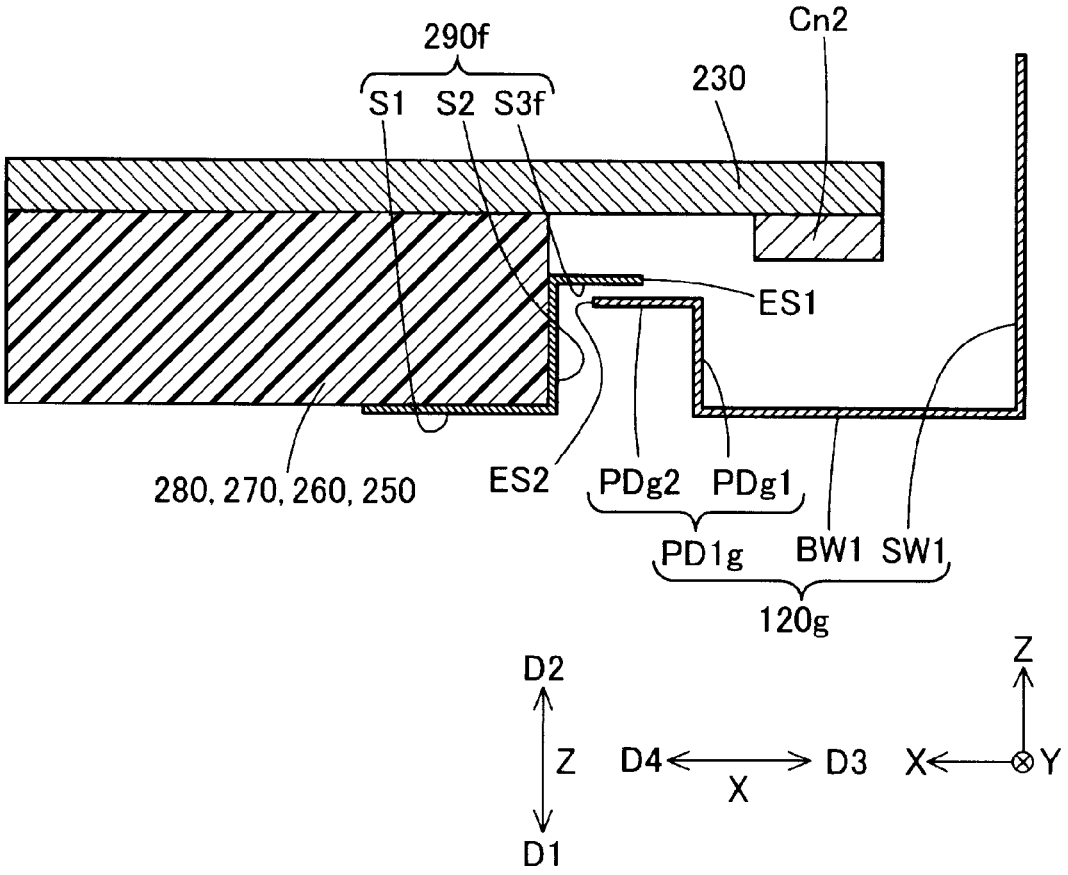
FIG. 19 is an explanatory view illustrating an arrangement configuration of a lid member and a carriage according to an eleventh embodiment.

FIG. 19 is an explanatory view illustrating an arrangement configuration of a lid member 290*f* and a carriage 120*g* included in the liquid ejecting apparatus according to an eleventh embodiment. The liquid ejecting apparatus according to the eleventh embodiment differs from the liquid ejecting apparatus according to the sixth embodiment in that the lid member 290*f* is provided instead of the lid member 290*b* and the carriage 120*g* is provided instead of the carriage 120*c*. The lid member 290*f* of the eleventh embodiment differs from the lid member 290*b* of the sixth embodiment in that a third surface S3*f* is provided instead of the third surface S3*b*. The carriage 120*g* of the eleventh embodiment differs from the carriage 120*c* of the sixth embodiment in that a protrusion portion PD1*g* is provided instead of the protrusion portion PD1*c*.

The third surface S3*f* of the lid member 290*f* has a shorter length in the direction along the X axis than that of the third surface S3*b* of the lid member 290*b* illustrated in FIG. 14. The protrusion portion PD1*g* of the carriage 120*g* differs from the protrusion portion PD1*c* of the carriage 120*c* illustrated in FIG. 14 in that the first protrusion portion PDg1 is provided instead of the first protrusion portion PDc1 and a second protrusion portion PDg2 is provided instead of the second protrusion portion PDc2. In detail, the first protrusion portion PDg1 has a longer length in the direction along the Z-axis than that of the first protrusion portion PDc1. The second protrusion portion PDg2 protrudes from an end portion of the first protrusion portion PDg1 in the fourth direction D4 toward the second surface S2. The end portion ES1 of the third surface S3*f* on the third direction D3 side overlaps the second protrusion portion PDg2 when viewed in the second direction D2.

According to the above-described liquid ejecting apparatus of the eleventh embodiment, the second protrusion portion PDg2 protrudes toward the second surface S2, and when viewed in the second direction D2, an end portion ES1 of the third surface S3*f* on the third direction D3 side overlaps the second protrusion portion PDg2, so that it is possible to suppress the ink from adhering to the third surface S3*f*. Therefore, it is possible to further suppress the ink from entering the inside of the carriage 120*g* via the gap between the lid member 290*f* and the carriage 120*g*.

L. Twelfth Embodiment

Figure 20:
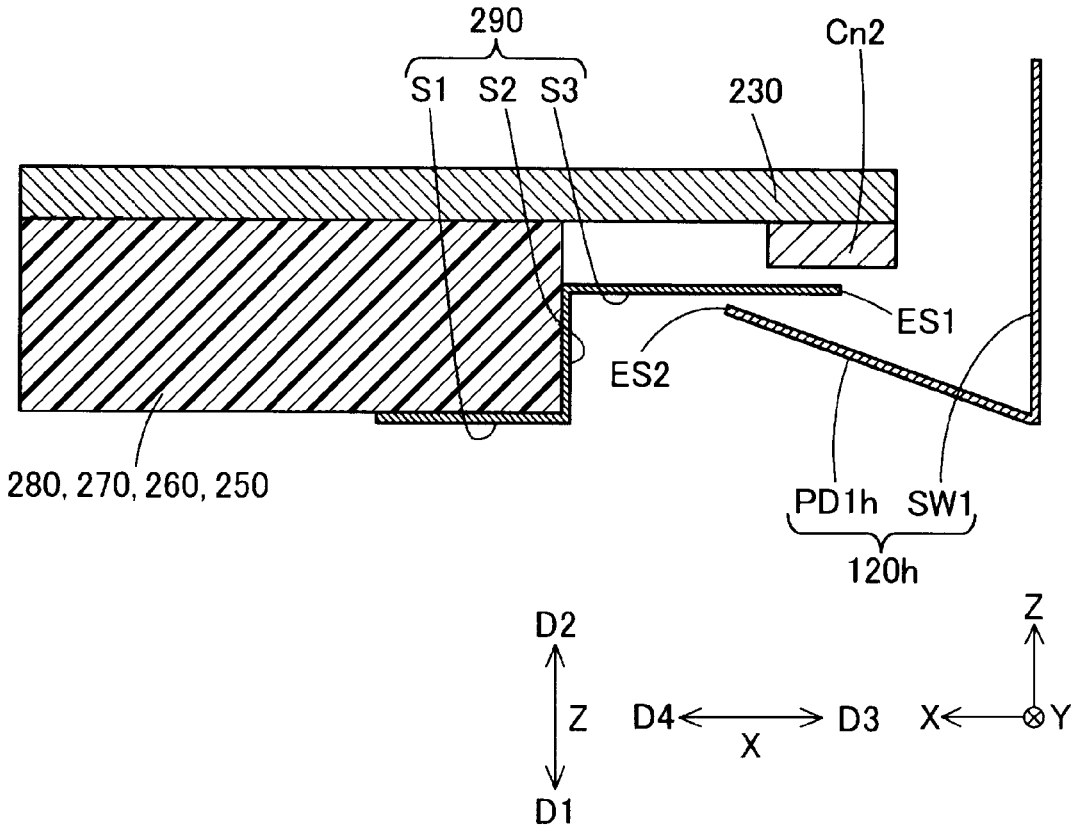
FIG. 20 is an explanatory view illustrating an arrangement configuration of a lid member and a carriage according to a twelfth embodiment.

FIG. 20 is an explanatory view illustrating an arrangement configuration of the lid member 290 and a carriage 120*h* included in the liquid ejecting apparatus according to a twelfth embodiment. The liquid ejecting apparatus of the twelfth embodiment differs from the liquid ejecting apparatus of the first embodiment in that a carriage 120*h* is provided instead of the carriage 120. The carriage 120*h* of the twelfth embodiment differs from the carriage 120 of the first embodiment illustrated in FIG. 7 in that a protrusion portion PD1*h* is provided instead of the protrusion portion PD1 and the bottom wall portion BW1 is omitted.

The protrusion portion PD1*h* protrudes from the end portion of the side wall portion SW1 on the first direction D1 side toward the third surface S3. In detail, the protrusion portion PD1*h* protrudes in the direction intersecting the second direction D2 and the fourth direction D4. The end portion ES2 of the protrusion portion PD1*h* on the second direction D2 side is disposed on the first direction D1 side from the third surface S3. The end portion ES1 of the third surface S3 on the third direction D3 side is disposed on the third direction D3 side from the end portion ES2 of the protrusion portion PD1*h*, and overlaps the protrusion portion PD1*h* when viewed in the second direction D2. Further, although not illustrated in FIG. 20, the insertion port CP2 of the connector Cn2 is located in the third direction D3 from a portion where the protrusion portion PD1*h* and the third surface S3 overlap each other when viewed in the second direction D2.

According to the above-described liquid ejecting apparatus of the twelfth embodiment, the protrusion portion PD1*h* protrudes toward the third surface S3, the end portion ES1 of the third surface S3 on the third direction D3 side is disposed on the third direction D3 side from the end portion ES2 of the protrusion portion PD1*h*, and when viewed in the second direction D2, the end portion ES1 of the third surface S3 overlaps the protrusion portion PD1*h*, so that it is possible to suppress the ink from adhering to the end portion ES1 side of the third surface S3. Therefore, it is possible to further suppress the ink from entering the inside of the carriage 120*h* via the gap between the lid member 290 and the carriage 120*h*.

M. Other Embodiments (1) In each of the above embodiments, the liquid ejecting apparatus 100 may include an ink tank and a pressure adjustment valve instead of the ink cartridge 117. In this case, the ink may be supplied from the ink tank via a flexible tube such as synthetic rubber to the pressure adjustment valve.

(2) In the above-described first embodiment, although the wiping member 300 moves in the third direction D3, the wiping member 300 may move in the fourth direction D4 relative to the liquid ejecting head 200. In this case, the wiping member 300 may wipe the surface of the nozzle plate 280 on the first direction D1 side by moving from the position P4 illustrated in FIG. 10 to the position P2.

(3) In each of the above-described embodiments, although the bottom wall portion of the carriage 120 is disposed to surround the entire circumference of the nozzle plate 280 when viewed in the second direction D2, a configuration may be employed in which a notch is provided at a part, and a part of the circumference of the nozzle plate 280 is not covered by the bottom wall portion. For example, The carriage 120 may be configured such that the bottom wall portions in the +Y direction and the −Y direction with respect to the nozzle plate 280 are omitted, and only the bottom wall portions in the +X direction and the −X direction with respect to the nozzle plate 280 are provided.

(4) In each of the above-described embodiments, the lid member 290 of the liquid ejecting head 200 may be configured such that a configuration on the third direction D3 side and a configuration on the fourth direction D4 side are plane-symmetric to each other. For example, in the lid member 290 of the liquid ejecting head 200 illustrated in FIG. 6, a configuration of the lid member 290 on the third direction D3 side and a configuration of the lid member 290 on the fourth direction D4 side may be common with a plane passing through a center O in the direction along the X axis and sandwiched along the Y-Z plane. Further, the outer wall of the carriage 120 may be configured such that a configuration on the third direction D3 side and a configuration on the fourth direction D4 side are plane-symmetric to each other. For example, in the carriage 120 illustrated in FIG. 6, a configuration of the outer wall of the carriage 120 on the third direction D3 side and a configuration of the outer wall of the carriage 120 on the fourth direction D4 side may be common with a plane passing through the center O in the direction along the X axis and sandwiched along the Y-Z plane.

(5) In each of the above embodiments, the liquid ejected from the nozzle 282 may be a liquid other than the ink. For example, the liquid may include (1) a color material used for manufacturing a color filter for an image displaying device such as a liquid crystal display, (2) an electrode material used for forming an electrode such as an organic electroluminescence (EL) display and a field emission display (FED), (3) a liquid containing a bio-organic substance used for manufacturing a biochip, (4) a sample as a precision pipette, (5) a lubricant, (6) a resin liquid, (7) a transparent resin liquid such as an ultraviolet curable resin liquid for forming a micro semispherical lens (optical lens) used for an optical communication device or the like, (8) a liquid that ejects an acidic or alkaline etching solution for etching a substrate, and (9) a predetermined other minute liquid droplet.

The "liquid droplet" refers to a state of a liquid ejected from the liquid ejecting apparatus 100, and includes a particle, a teardrop, and a thread having a tail. Further, the "liquid" referred to here may be any material that can be consumed by the liquid ejecting apparatus 100. For example, the "liquid" may be any material in a state when a substance is in a liquid phase, and a liquid material having high or low viscosity and liquid materials such as sol, gel water, other inorganic solvents, organic solvents, solutions, liquid resins, and liquid metals (metallic melt) are also included in the "liquid." Further, not only a liquid as one state of a substance but also a liquid in which particles of a functional material made of a solid material such as a pigment or metal particles are dissolved, dispersed, or mixed in a solvent are included in the "liquid." Typical examples of the liquid include ink and liquid crystal. Here, the ink includes various liquid compositions such as general water-based ink, oil-based ink, gel ink, and hot melt ink. Even in these configurations, the same effect as those of embodiments can be obtained.

N. Other Forms

The present disclosure is not limited to the above-described embodiments, and can be implemented in various configurations without departing from the spirit thereof. For example, the technical features in the embodiments corresponding to the technical features in each mode described in the section of the summary of the disclosure can be appropriately replaced or combined in order to solve some or all of the above problems or achieve some or all of the above effects. Further, when the technical features are not described as essential in the specification, the technical features can be appropriately deleted.

1. According to an embodiment of the present disclosure, a liquid ejecting apparatus is provided. This liquid ejecting apparatus includes: a liquid ejecting head that has a nozzle plate provided with a plurality of nozzles for ejecting a liquid in a first direction, a case head disposed in a second direction opposite to the first direction with respect to the nozzle plate and configured to supply a liquid to the nozzle, and a lid member provided with an opening exposing the plurality of nozzles and configured to cover the first direction side of the nozzle plate and a third direction side of the nozzle plate and the case head, the third direction orthogonal to the first direction; and a carriage on which the liquid ejecting head is mounted and which has an outer wall surrounding a periphery of the nozzle plate when viewed in the second direction, in which the lid member has a first surface, a second surface, and a third surface, the first surface is disposed in the first direction with respect to the nozzle plate, the second surface is coupled to the first surface and is disposed to cover a part of a side surface of the case head in the third direction, the third surface is coupled to the second surface to extend in the third direction and is disposed so as not to abut on the outer wall, and an end portion of the third surface in the third direction overlaps the outer wall when viewed in the second direction.

According to the liquid ejecting apparatus of this aspect, since the third surface of the lid member is coupled to the second surface of the lid member to extend in the third direction and is disposed so as not to abut on the outer wall of the carriage, and the end portion of the third surface on the third direction side overlaps the outer wall of the carriage when viewed in the second direction, it is possible to suppress the liquid from entering the inside of the carriage via the gap between the lid member and the carriage. In addition, since the third surface of the lid member and the outer wall of the carriage are not in contact with each other, it is possible to suppress a stress caused by the peeling of the lid member from the liquid ejecting head from being applied to the third surface.

2. In the liquid ejecting apparatus according to the aspect, the liquid ejecting head may have a circuit board provided in the second direction with respect to the case head, a connector may be provided on a surface of the circuit board on the first direction side, and the third surface may be disposed in the first direction with respect to the connector.

According to the liquid ejecting apparatus of this aspect, since the third surface is disposed in the first direction from the connector, it is possible to suppress the liquid from adhering to the connector.

3. In the liquid ejecting apparatus according to the aspect, the third surface may overlap the connector when viewed in the second direction.

According to the liquid ejecting apparatus of this aspect, since the third surface overlaps the connector when viewed in the second direction, it is possible to further suppress the ink from adhering to the connector.

4. In the liquid ejecting apparatus according to the aspect, the outer wall may be located in the first direction from the third surface, and the outer wall may have a bottom wall portion and a protrusion portion protruding from the bottom wall portion to the third surface.

According to the liquid ejecting apparatus of this aspect, since the outer wall is located in the first direction from the third surface, and the outer wall has the bottom wall portion and the protrusion portion protruding from the bottom wall portion to the third surface, even when liquid droplets are scattered on the carriage side, it is possible to suppress the liquid droplets from entering the inside of the carriage.

5. In the liquid ejecting apparatus according to the aspect, in the third direction, a distance between the second surface and an end portion of the protrusion portion on the third surface side may be smaller than a distance between the second surface and an opposite end portion opposite to the end portion.

According to the liquid ejecting apparatus of this aspect, since in the third direction, the distance between the end portion of the protrusion portion on the third surface side and the second surface is smaller than the distance between an end portion opposite to the end portion of the protrusion portion on the third surface side and the second surface, it is possible to suppress the liquid droplets from adhering to the third surface. Therefore, it is possible to further suppress the liquid from entering the inside of the carriage through the gap between the lid member and the carriage.

6. In the liquid ejecting apparatus according to the aspect, the protrusion portion may include a first protrusion portion protruding from the bottom wall portion in the second direction and a second protrusion portion protruding from the first protrusion portion in a fourth direction opposite to the third direction, and the third surface may overlap the second protrusion portion when viewed in the second direction.

According to the liquid ejecting apparatus of this aspect, since the protrusion portion has the first protrusion portion protruding from the bottom wall portion in the second direction and the second protrusion portion protruding from the first protrusion portion in the fourth direction opposite to the third direction, and the third surface overlaps the second protrusion portion when viewed in the second direction, even when the liquid droplets are scattered on the carriage side, it is possible to suppress the liquid droplets from entering the inside of the carriage.

7. In the liquid ejecting apparatus according to the aspect, an angle formed between the first surface and the second surface may be 90 degrees, and an angle formed between the second surface and the third surface may be 90 degrees or more.

According to the liquid ejecting apparatus of this aspect, since the angle formed between the first surface and the second surface is 90 degrees, the lid member and the case head can be easily positioned. Since the angle formed between the second surface and the third surface is 90 degrees or more, it is possible to suppress the liquid from moving to the carriage side due to gravity, as compared to a configuration in which the angle formed between the second surface and the third surface is less than 90 degrees. Further, the lid member can be easily manufactured.

8. In the liquid ejecting apparatus according to the aspect, a minimum distance between the outer wall and the third surface in the first direction may be 1 mm or less at a portion where the outer wall and the third surface overlap each other when viewed in the second direction.

According to the liquid ejecting apparatus of this aspect, since the minimum distance between the outer wall and the third surface in the first direction may be 1 mm or less at a portion where the outer wall and the third surface overlap each other when viewed in the second direction, the gap between the outer wall and the third surface can be made smaller. Therefore, it is possible to suppress the liquid from entering the inside of the carriage via the gap between the third surface and the carriage.

9. In the liquid ejecting apparatus according to the aspect, the lid member may have a fourth surface and a fifth surface, the fourth surface may be coupled to the first surface and disposed to cover a part of a side surface of the case head in a fourth direction opposite to the third direction, the fifth surface may be coupled to the fourth surface and to extend in the fourth direction and disposed not to abut on the outer wall, and an end portion of the fifth surface in the fourth direction may overlap the outer wall when viewed in the second direction.

According to the liquid ejecting apparatus of this aspect, in the liquid ejecting head, since the fifth surface of the lid member is disposed to be coupled to the fourth surface of the lid member to extend in the fourth direction so as not to abut on the outer wall of the carriage, and the end portion of the fifth surface on the fourth direction side overlaps the outer wall of the carriage when viewed in the second direction, even on the fourth direction side of the liquid ejecting head, it is possible to suppress the liquid from entering the inside of the carriage via the gap between the lid member and the carriage. In addition, since the fifth surface of the lid member and the outer wall of the carriage are not in contact with each other, it is possible to suppress a stress caused by the peeling of the lid member from the liquid ejecting head from being applied to the fifth surface.

10. The liquid ejecting apparatus according to the aspect may include a wiping member for wiping a surface of the nozzle plate on the first direction side.

According to the liquid ejecting apparatus of this aspect, since the wiping member for wiping the surface of the nozzle plate on the first direction side is provided, the liquid droplets adhering to the nozzle plate can be easily wiped off as compared with a configuration in which the wiping member is not provided. As a result, in the liquid ejecting apparatus, it is possible to suppress the occurrence of defects caused by the liquid adhering to the nozzle plate.

11. In the liquid ejecting apparatus according to the aspect, the wiping member may move relative to the liquid ejecting head in one of the third direction or a fourth direction opposite to the third direction while contacting the surface of the nozzle plate on the first direction side.

According to the liquid ejecting apparatus of this aspect, since the wiping member may move relative to the liquid ejecting head in one of the third direction or the fourth direction opposite to the third direction while contacting the surface of the nozzle plate on the first direction side, the third surface of the lid member exists along a movement direction of the wiping member, and even when the liquid droplets are scattered during the wiping of the nozzle plate, it is possible to suppress the liquid droplets from entering the inside of the carriage by the third surface.

12. In the liquid ejecting apparatus according to the aspect, the nozzle plate may have 10 nozzle rows configured such that the plurality of nozzles are arranged side by side in a direction orthogonal the first direction and the third direction, and the nozzle rows may be arranged side by side along the third direction.

According to the liquid ejecting apparatus of this aspect, since the nozzle rows are arranged side by side along the third direction, a movement direction of the wiping member and a direction in which the nozzle rows are arranged can be the same direction. Therefore, the wiping member can be downsized. Further, the movement direction of the wiping member and the scanning direction of the carriage can be the same direction. Therefore, the nozzle plate can be wiped by the wiping member by scanning the carriage.

13. In the liquid ejecting apparatus according to the above aspect, the wiping member may not contact the third surface.

According to the liquid ejecting apparatus of this aspect, since the wiping member does not contact the third surface, the wiping member can be accommodated in a region between the lid member and the carriage. Therefore, the liquid ejecting apparatus can be downsized.

14. In the liquid ejecting apparatus according to the aspect, a clearance of 1 mm or more may be formed between a tip of the wiping member in the second direction and the third surface.

According to the liquid ejecting apparatus of this aspect, since the clearance of 1 mm or more may be formed between the tip of the wiping member in the second direction and the third surface, it is possible to suppress the liquid adhering to the tip of the wiping member from adhering to the third surface.

15. In the liquid ejecting apparatus according to the aspect, the liquid ejecting head may have a circuit board provided in the second direction with respect to the case head, a connector may be provided on a surface of the circuit board on the first direction side, a signal cable inserted into an insertion port of the connector that opens in the third direction may be provided, and the insertion port may be located in the third direction from a portion where the outer wall and the third surface overlap each other when viewed in the second direction.

According to the liquid ejecting apparatus of this aspect, since the insertion port of the connector is located in the third direction from the portion where the outer wall of the carriage and the third surface of the lid member overlap each other when viewed in the second direction, it is possible to suppress the liquid from adhering to the insertion port of the connector.

The present disclosure can be realized in various forms other than the liquid ejecting apparatus. For example, the present disclosure can be realized in the form of a liquid ejecting head, a lid member used for the liquid ejecting head, a carriage used for the liquid ejecting apparatus, or the like.

What is claimed is:

1. A liquid ejecting apparatus comprising:

a liquid ejecting head having a nozzle plate provided with nozzles configured to eject a liquid in a first direction, a case head disposed in a second direction opposite to the first direction with respect to the nozzle plate and configured to supply a liquid to the nozzle, and a lid member provided with an opening exposing the nozzles and configured to cover the first direction side of the nozzle plate and a third direction side of the nozzle plate and the case head, the third direction being orthogonal to the first direction; and a carriage on which the liquid ejecting head is mounted and which has an outer wall surrounding a periphery of the nozzle plate when viewed in the second direction, wherein the lid member has a first surface, a second surface, and a third surface, the first surface is disposed in the first direction with respect to the nozzle plate, the second surface is coupled to the first surface and is disposed to cover a part of a side surface of the case head in the third direction, the third surface is coupled to the second surface to extend in the third direction and is disposed so as not to abut on the outer wall, and an end portion of the third surface in the third direction overlaps the outer wall when viewed in the second direction.

2. The liquid ejecting apparatus according to claim 1, wherein the liquid ejecting head has a circuit board provided in the second direction with respect to the case head, a connector is provided on a surface of the circuit board on the first direction side, and the third surface is disposed in the first direction with respect to the connector.

3. The liquid ejecting apparatus according to claim 2, wherein the third surface overlaps the connector when viewed in the second direction.

4. The liquid ejecting apparatus according to claim 1, wherein the outer wall is located in the first direction from the third surface, and the outer wall has a bottom wall portion and a protrusion portion protruding from the bottom wall portion to the third surface.

5. The liquid ejecting apparatus according to claim 4, wherein in the third direction, a distance between the second surface and an end portion of the protrusion portion on the third surface side is smaller than a distance between the second surface and an opposite end portion opposite to the end portion.

6. The liquid ejecting apparatus according to claim 4, wherein the protrusion portion includes a first protrusion portion protruding from the bottom wall portion in the second direction and a second protrusion portion protruding from the first protrusion portion in a fourth direction opposite to the third direction, and the third surface overlaps the second protrusion portion when viewed in the second direction.

7. The liquid ejecting apparatus according to claim 1, wherein an angle formed between the first surface and the second surface is 90 degrees, and an angle formed between the second surface and the third surface is 90 degrees or more.

8. The liquid ejecting apparatus according to claim 1, wherein the outer wall includes a first portion where the outer wall and the third surface overlap each other when viewed in the second direction, the third surface includes a second portion where the outer wall and the third surface overlap each other when viewed in the second direction, and a minimum distance between the first portion of the outer wall and the second portion of the third surface in the first direction is 1 mm or less.

9. The liquid ejecting apparatus according to claim 1, wherein the lid member has a fourth surface and a fifth surface, the fourth surface is coupled to the first surface and disposed to cover a part of a side surface of the case head in a fourth direction opposite to the third direction, the fifth surface is coupled to the fourth surface and to extend in the fourth direction and disposed not to abut on the outer wall, and an end portion of the fifth surface in the fourth direction overlaps the outer wall when viewed in the second direction.

10. The liquid ejecting apparatus according to claim 1, further comprising:

a wiping member configured to wipe the nozzle plate.

11. The liquid ejecting apparatus according to claim 10, wherein the wiping member moves relative to the liquid ejecting head in one of the third direction or the fourth direction opposite to the third direction while contacting the nozzle plate.

12. The liquid ejecting apparatus according to claim 10, wherein the nozzle plate has 10 nozzle rows configured such that the nozzles are arranged side by side in a direction orthogonal the first direction and the third direction, and the nozzle rows are arranged side by side along the third direction.

13. The liquid ejecting apparatus according to claim 10, wherein the wiping member does not contact the third surface.

14. The liquid ejecting apparatus according to claim 13, wherein a clearance of 1 mm or more is formed between a tip of the wiping member in the second direction and the third surface.

15. The liquid ejecting apparatus according to claim 1, further comprising a signal cable, wherein the liquid ejecting head has a circuit board provided in the second direction with respect to the case head, a connector is provided on a surface of the circuit board on the first direction side, the signal cable is inserted into an insertion port of the connector that opens in the third direction, and the insertion port is located in the third direction with respect to a portion where the outer wall and the third surface overlap each other when viewed in the second direction.

16. The liquid ejecting apparatus according to claim 1, wherein the nozzle plate has a nozzle row configured such that the nozzles are arranged side by side in a direction orthogonal the first direction, and a width of the third surface in a fifth direction orthogonal the first direction and the third direction is larger than a width of the nozzle row in the fifth direction.

* * * * *